US007367125B2

(12) United States Patent
Aviza

(10) Patent No.: US 7,367,125 B2
(45) Date of Patent: May 6, 2008

(54) SHAVING SYSTEMS

(75) Inventor: Gregory D. Aviza, Marlborough, MA (US)

(73) Assignee: The Gillette Company, Boston, MA (US)

( * ) Notice: Subject to any disclaimer, the term of this patent is extended or adjusted under 35 U.S.C. 154(b) by 513 days.

(21) Appl. No.: 10/732,555

(22) Filed: Dec. 10, 2003

(65) Prior Publication Data

US 2005/0126007 A1 Jun. 16, 2005

(51) Int. Cl.
*B21B 21/22* (2006.01)
*B21B 21/40* (2006.01)

(52) U.S. Cl. ..... 30/34.05; 30/50; 30/79

(58) Field of Classification Search ..... 30/34.05, 30/34.2, 50, 32, 59
See application file for complete search history.

(56) References Cited

U.S. PATENT DOCUMENTS

| | | | |
|---|---|---|---|
| 393,330 | A | 11/1888 | Friegel |
| 1,910,647 | A | 5/1933 | Steeg et al. |
| 2,010,332 | A | 8/1935 | Steeg et al. |
| 2,040,599 | A | 5/1936 | Davies |
| 2,048,565 | A | 7/1936 | Rodrigues |
| 2,231,453 | A | 2/1941 | Pitar et al. |
| 2,311,060 | A | 2/1943 | Lurrain |
| 2,328,886 | A | 9/1943 | Andrews et al. |
| 2,714,788 | A | 8/1955 | DiGiovanna |
| 3,263,328 | A | 8/1966 | Craig |
| 3,596,661 | A | 8/1971 | Motz |
| 3,909,942 | A | 10/1975 | Ciaffone et al. |
| 3,939,560 | A | 2/1976 | Lyall |
| 3,964,159 | A | 6/1976 | Ferraro et al. |
| 4,345,374 | A | 8/1982 | Jacobson |
| 4,378,634 | A | 4/1983 | Jacobson |
| 4,425,705 | A | 1/1984 | Chen |
| 4,459,987 | A | 7/1984 | Pangburn |
| 4,473,944 | A | 10/1984 | Carroll |
| D282,591 | S | 2/1986 | Usem et al. |
| D282,592 | S | 2/1986 | Usem et al. |
| 4,572,222 | A | 2/1986 | Pangburn |
| 4,712,552 | A | 12/1987 | Pangburn |
| 4,741,103 | A | 5/1988 | Hultman |
| 4,944,090 | A | 7/1990 | Sumnall |
| 5,036,587 | A | 8/1991 | Trotta et al. |
| 5,084,046 | A | 1/1992 | Isack |
| 5,084,968 | A | 2/1992 | Trotta |
| 5,084,969 | A | 2/1992 | Althaus |
| 5,279,080 | A | 1/1994 | Muller et al. |
| 5,347,716 | A | 9/1994 | Crook |

(Continued)

FOREIGN PATENT DOCUMENTS

| | | |
|---|---|---|
| EP | 0 854 019 | 7/1998 |

(Continued)

OTHER PUBLICATIONS

U.S. Appl. No. 10/798,496, filed on Mar. 11, 2004.*

(Continued)

*Primary Examiner*—Timothy V. Eley
(74) *Attorney, Agent, or Firm*—Joanne N. Pappas

(57) ABSTRACT

A wet-shaving system can include an exfoliation member, the position of which is adjustable relative to a housing and/or handle portion of the wet-shaving system.

35 Claims, 26 Drawing Sheets

U.S. PATENT DOCUMENTS

| | | | | |
|---|---|---|---|---|
| 5,461,781 | A | 10/1995 | Pirc et al. | |
| D369,410 | S | 4/1996 | Holt | |
| D369,411 | S | 4/1996 | Holt | |
| D369,658 | S | 5/1996 | Holt | |
| D369,665 | S | 5/1996 | Holt | |
| 5,671,534 | A | 9/1997 | Mayerovitch et al. | |
| 5,787,586 | A | 8/1998 | Apprille, Jr. et al. | |
| 5,800,446 | A | 9/1998 | Banuchi | |
| 5,802,720 | A | 9/1998 | Pribe | |
| D405,919 | S | 2/1999 | Halk | |
| 5,953,825 | A * | 9/1999 | Christman et al. | 30/527 |
| 5,956,848 | A | 9/1999 | Tseng | |
| 5,956,849 | A | 9/1999 | Chadwick et al. | |
| 6,052,905 | A | 7/2000 | Branchinelli et al. | |
| 6,185,823 | B1 | 2/2001 | Brown et al. | |
| 6,216,561 | B1 | 4/2001 | Dischler | |
| 6,248,115 | B1 | 6/2001 | Halk | |
| 6,283,978 | B1 | 9/2001 | Cheski et al. | |
| 6,290,707 | B1 | 9/2001 | Street | |
| 6,295,734 | B1 * | 10/2001 | Gilder et al. | 30/50 |
| 6,442,840 | B2 * | 9/2002 | Zucker | 30/42 |
| 6,671,961 | B1 * | 1/2004 | Van Eibergen et al. | 30/50 |
| 2004/0181943 | A1 * | 9/2004 | Kwiecien | 30/41 |

FOREIGN PATENT DOCUMENTS

| | | |
|---|---|---|
| EP | 1 287 953 | 3/2003 |
| GB | 127 195 | 5/1919 |
| JP | 54-13784 | 1/1979 |
| WO | WO94/04116 | 3/1994 |
| WO | WO96/02370 | 2/1996 |

OTHER PUBLICATIONS

"Physical Exfoliants", *Cosmetics and Toiletries Manufacture Worldwide*, pp. 37-43 Available Web Site: www.connock.co.uk Published prior to the filing of the application.

Buff Naked Sport Hair Removing Shower Mitts, available prior to Dec. 10, 2003.

Sally Hansen Epilette® and Hair Off® Mitten, available prior to Dec. 10, 2003.

Hair Off® Mitten, available prior to Dec. 10, 2003.

Schick® Intuition™ razor, available prior to Dec. 10, 2003.

* cited by examiner

FIG. 2E
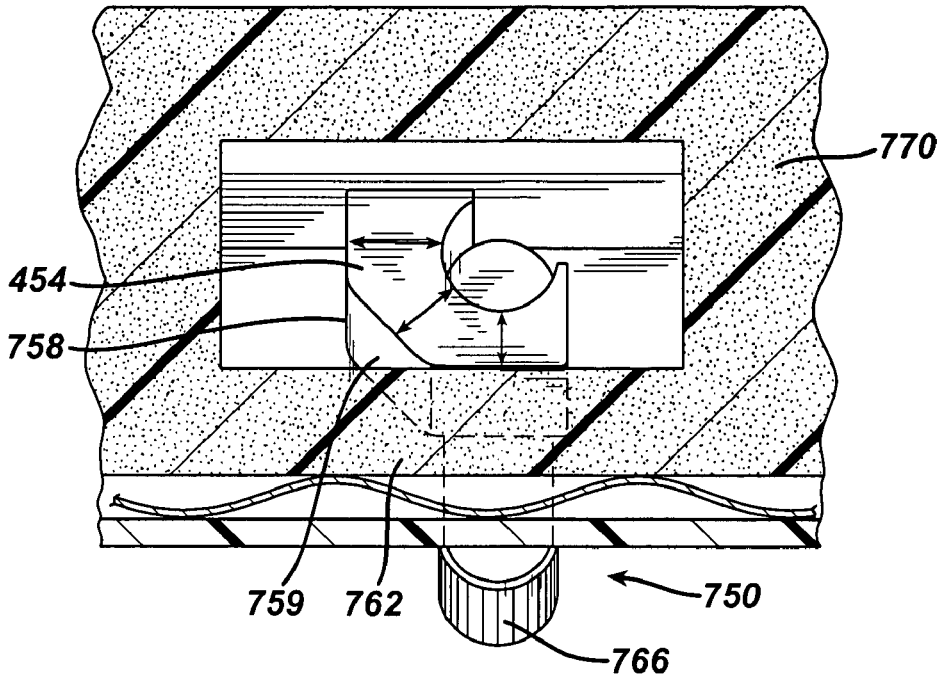
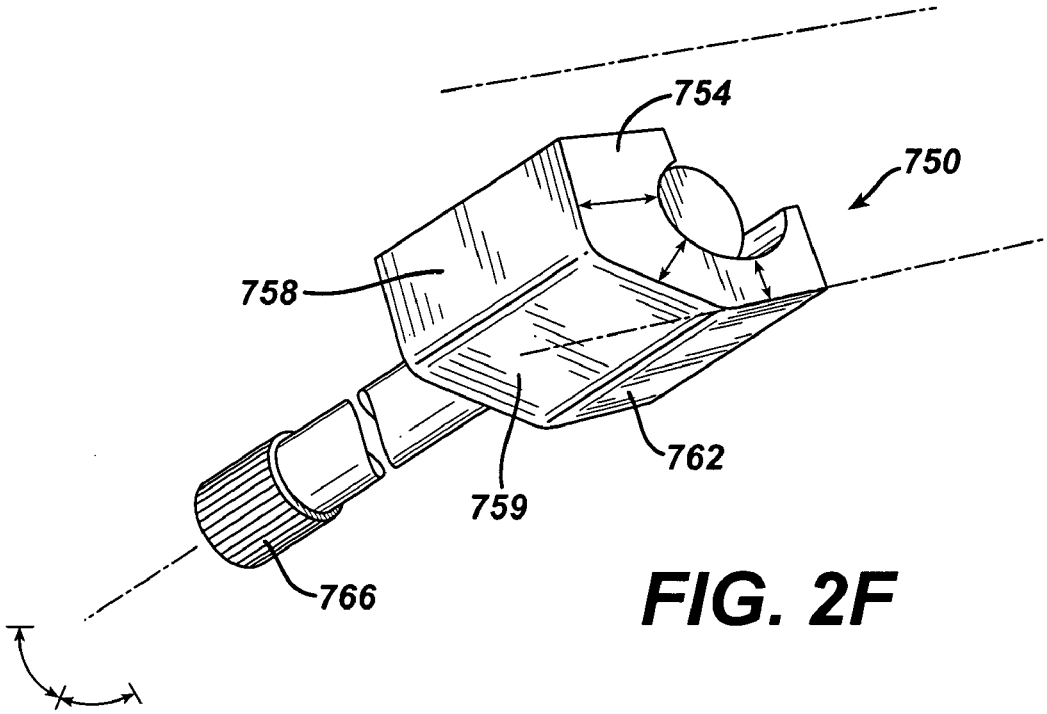
FIG. 2F

SHAVING SYSTEMS

TECHNICAL FIELD

This invention relates to shaving systems.

BACKGROUND

Exfoliation can generally be described as the peeling off of flakes or scales of dead skin. The look and overall feel of the skin can be improved by exfoliation. Exfoliation may be achieved, for example, by the use of cosmetics that include abrasive particles or by rubbing the skin with an abrasive material, such as a loofah.

It is known to enhance the tactile properties of a wet-shaving system. For example, Lyall, U.S. Pat. No. 3,939,560, discloses shaving equipment with a roughened guard surface. The guard surface in Lyall can be roughened by abrading it with particles or, alternatively, by coating or impregnating it with particles.

SUMMARY

The invention generally relates to shaving systems with adjustable exfoliation members. It can be desirable to adjust the exfoliation members because, for example, different users may desire different degrees of exfoliation.

In one aspect, the invention features a wet-shaving system with a housing. A blade member is mounted on the housing. The wet-shaving system also includes an exfoliation member that is in proximity to the blade member. By "in proximity to," we mean that the exfoliation member may be immediately adjacent to the blade member or may be spaced from the blade member but sufficiently close to the blade member so as to perform its exfoliating function during shaving. The position of the exfoliation member relative to the housing is adjustable to vary the amount or force of contact between the exfoliation member and a skin surface of a user during shaving.

In another aspect, the invention features a shaving system with a body portion and a cartridge portion that is attached to the body portion. A blade member is mounted on the cartridge portion. The shaving system further includes a handle portion that extends from the body portion, and an exfoliation member that is mounted on the handle portion. The position of the exfoliation member relative to the handle portion is adjustable.

Embodiments can include one or more of the following.

The position of the exfoliation member relative to the housing can be adjustable to vary the surface area of the exfoliation member that contacts the user's skin. The height of the exfoliation member relative to a leading edge of the blade member can be adjustable (e.g., to control pressure). The angle of the exfoliation member relative to a leading skin-engaging surface of the housing can be adjustable (e.g., to control pressure).

The shaving system can further include an adjustment mechanism that can adjust the position of the exfoliation member.

The adjustment mechanism can include a cam that is disposed within a cavity defined by the exfoliation member. In such cases, the adjustment mechanism can further include a shaft with a first end that is connected to the cam, and a second end that is disposed external to the housing. The cam can be adapted to be actuated by movement of the shaft.

The adjustment mechanism can include a link that is coupled to the exfoliation member at a first end and to a slide actuator at a second end. The slide actuator can be capable of adjusting the position of the link.

The adjustment mechanism can include a wheel with a thickness that varies around its circumference. A first portion of the wheel can be disposed beneath the exfoliation member, and a second portion of the wheel can be exposed to allow the user to turn the wheel. In such cases, the exfoliation member can be mounted on a hinge, and the wheel can be configured to pivot the exfoliation member about the hinge.

The adjustment mechanism can include a rod that is disposed beneath the exfoliation member. The rod can be adapted to apply pressure to the exfoliation member when the rod is actuated by a user. In such cases, the exfoliation member can be mounted on a hinge. The rod can be configured to pivot the exfoliation member about the hinge.

The adjustment mechanism can include an adjustable cover (e.g., of a clear plastic material). The user can position the cover over all, a portion, or none of an exposed surface of the exfoliation member.

The adjustment mechanism can include a screw thread post that is in contact with the exfoliation member and that is disposed within a thumb wheel.

The adjustment mechanism can include a spring (e.g., a wave spring, a coil spring) that is disposed under the exfoliation member.

The adjustment mechanism can include a pivot, a slide, a lever (e.g., that is disposed beneath the exfoliation member), a spring, a cam surface, a wheel, or a screw.

The exfoliation member can include a cylindrical roller that is disposed on a shaft (e.g., an eccentric shaft). In such cases, the adjustment mechanism can include a wheel that is configured to rotate the shaft. The cylindrical roller can have an external surface with at least two different types of exfoliating elements disposed on it.

The exfoliation member can include, for example, a plate, a roller or a pad. The exfoliation member can include a bow plate.

The shaving system can further include a guard portion that is adjacent to the exfoliation member.

The exfoliation member can have an exfoliating surface that is an abrasive surface, a molded textured surface, a mesh, a textured metal surface, and/or a stone surface. The exfoliation member can include abrasive particles and/or fibers.

The exfoliation member can include a shaving aid matrix having a shaving aid.

The exfoliation member can be fixedly mounted, and a portion of the housing can be movable relative to the exfoliation member.

The exfoliation member can be fixedly mounted, and a shaving surface of the blade member can be movable relative to the exfoliation member.

Embodiments can include one or more of the following advantages. A user can adjust and/or fine-tune the degree of exfoliation to suit his or her comfort level. By using an adjustable exfoliation member, a user can choose, for example, whether to exfoliate infrequently and at a high exfoliation level, or to exfoliate frequently and at a low exfoliation level. A user can exfoliate regularly without causing significant discomfort to the skin. Time spent on skin care can be reduced, since a user can exfoliate and shave simultaneously. The exfoliating material can help to release hairs trapped just below the skin surface. Furthermore, the exfoliating material can favorably orient the hairs just before the hairs are cut by the razor blades, leading to a closer and more efficient shave.

Other features and advantages of the invention will be apparent from the description and drawings, and from the claims.

DESCRIPTION OF DRAWINGS

FIG. 2E is a perspective view in partial cross-section of an adjustment mechanism.

FIG. 2F is a perspective view of the adjustment mechanism of FIG. 2E.

DETAILED DESCRIPTION

The invention generally relates to shaving systems with adjustable exfoliation members. The exfoliation members can be adjusted manually or automatically.

Figure 1:
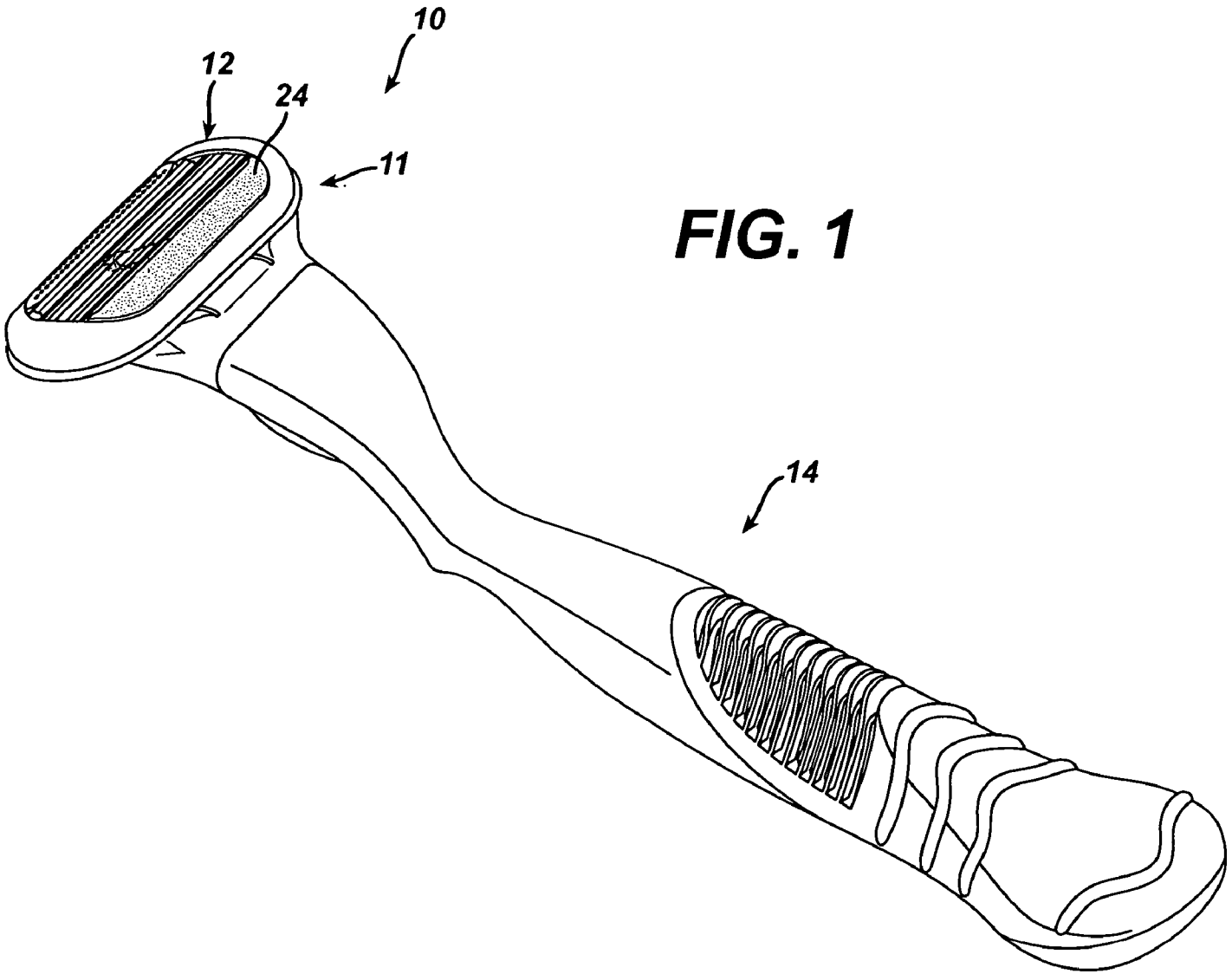
FIGS. 1 and 1A are perspective views of a shaving system.
Figure 1A:
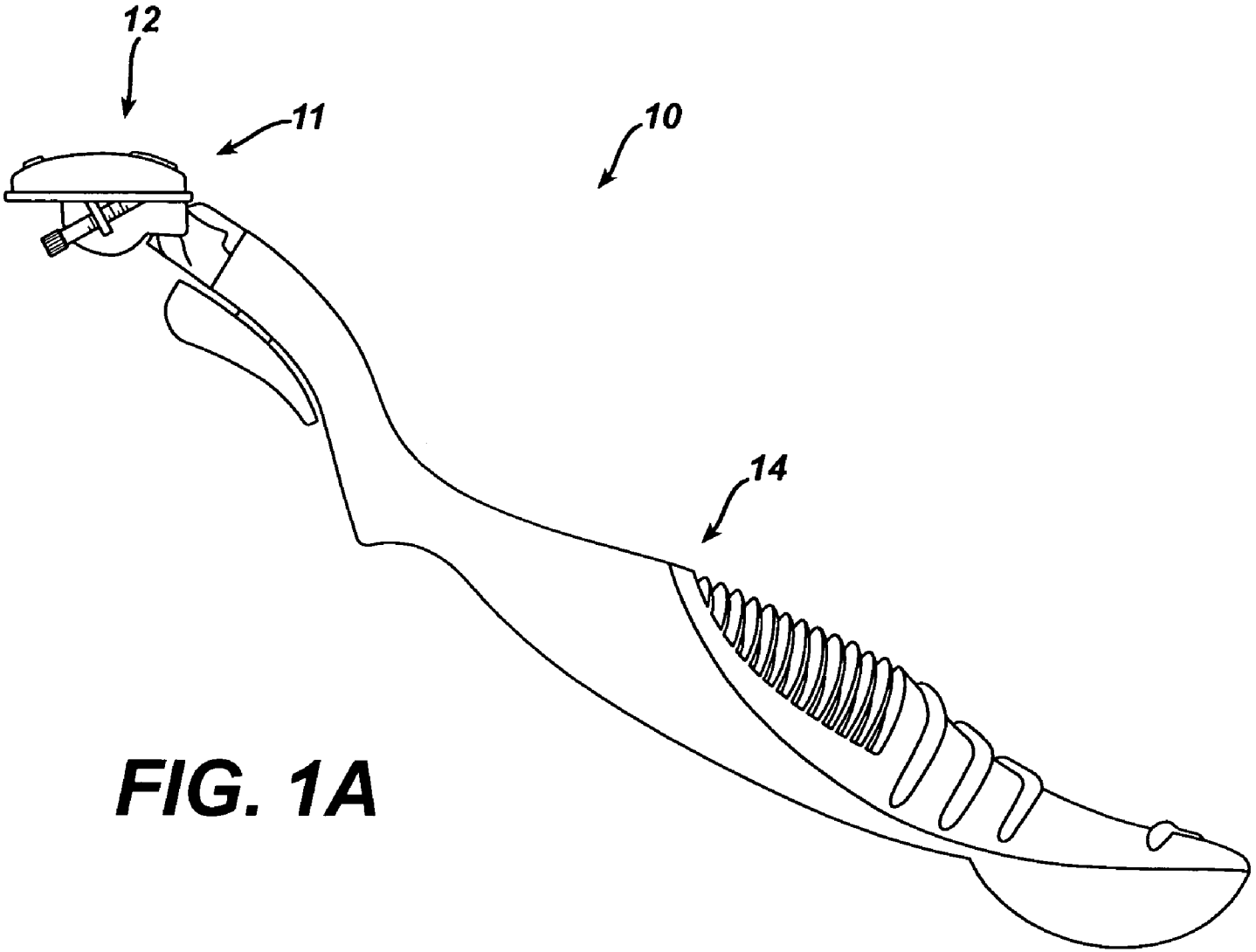

FIGS. 1 and 1A show a wet-shaving system with an exfoliation member that can be adjusted manually. In FIGS. 1 and 1A, wet-shaving system 10 includes a shaving portion 11 attached to a handle portion 14. Shaving portion 11 has a replaceable cartridge 12. While wet-shaving system 10 of FIGS. 1 and 1A includes a replaceable cartridge, in some embodiments it can include a shaving head which is integral with handle portion 14, so that the complete razor is discarded as a unit when the blade or blades become dulled.

Figure 2:
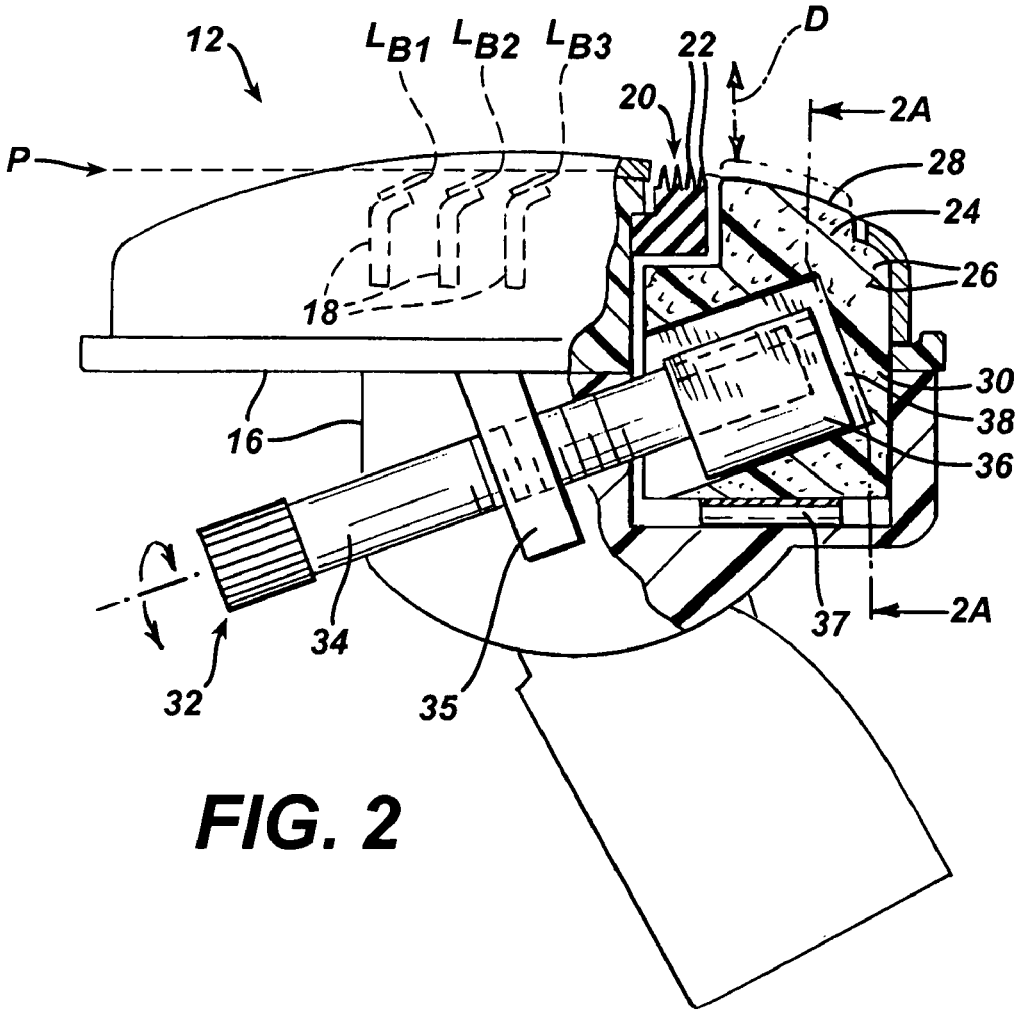
FIG. 2 is a side view in partial cross-section of a cartridge of the shaving system of FIGS. 1 and 1A.
Figure 3:
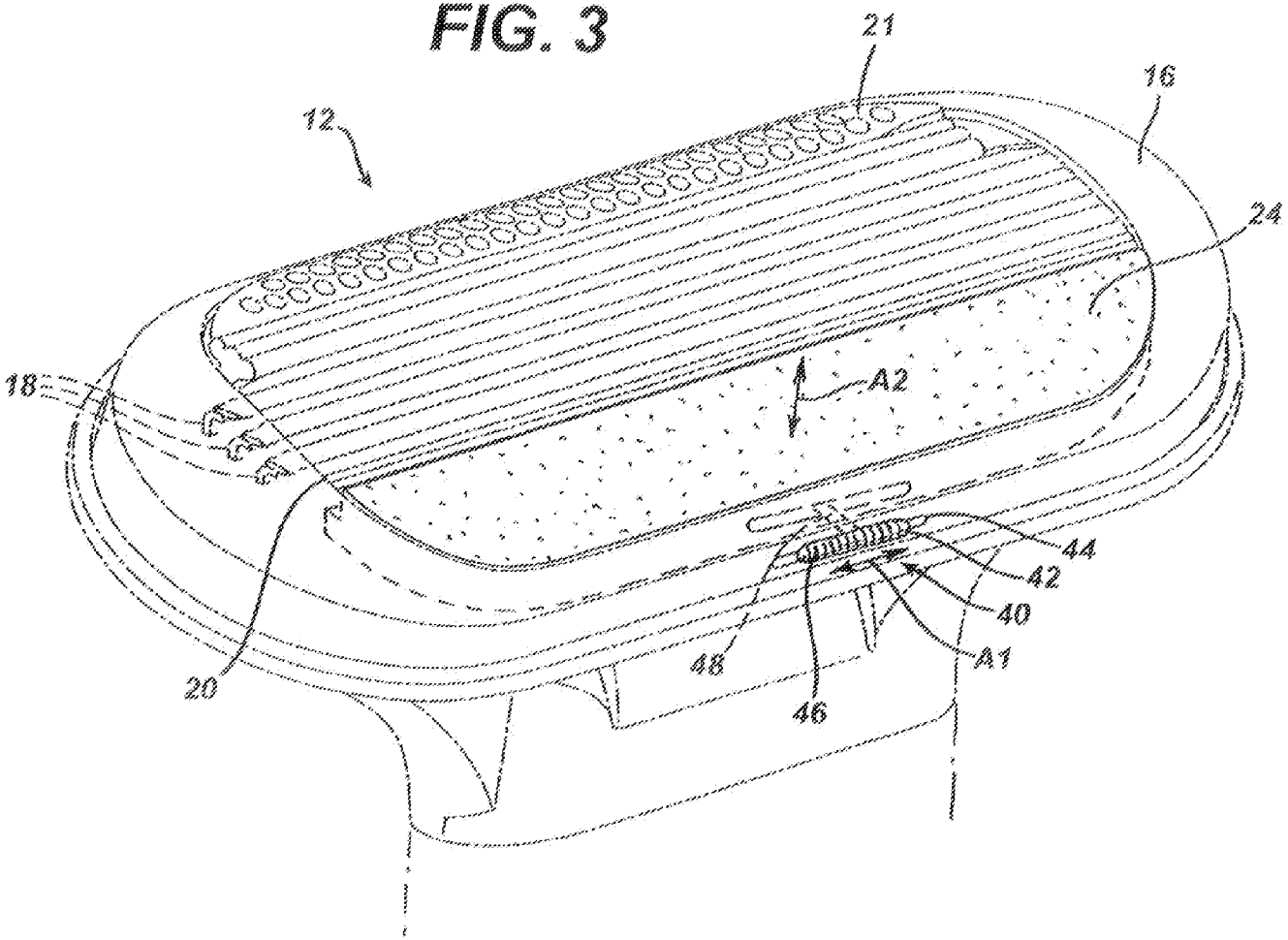
FIG. 3 is a perspective view of a cartridge.

Referring also now to FIGS. 2 and 3, cartridge 12 includes a housing 16, which carries three blades 18, a guard 20, and a cap 21 (FIG. 3). Blades 18 each have a leading edge ($L_{B1}$, $L_{B2}$, or $L_{B3}$). The leading edges lie along a plane P. Guard 20 is in the form of a plurality of fins 22 made of, for example, plastic (e.g., an elastomer and/or urethane). Fins 22 can help to stretch the skin and/or to orient the hairs in a position that is optimal for shaving. In some cases, fins 22 can desensitize the skin to improve comfort during shaving. Although guard 20 includes fins in FIG. 2, guard 20 can have many other different geometries. As an example, in some embodiments guard 20 can be in the form of a pad or a ridge with, e.g., recesses or raised surfaces such as bumps.

Adjacent to guard 20 is an exfoliation member 24, which includes exfoliating elements 26. In FIG. 2, exfoliation member 24 is located in front of blades 18, such that a user's skin generally will contact the exfoliation member before contacting the blades. Thus, the user's skin typically will be exfoliated immediately before being shaved. Suitable exfoliating elements include those described in co-owned and co-pending U.S. patent application Ser. No. 60/455,646, filed Mar. 18, 2003, and entitled "Shaving Systems", the entire contents of which are hereby incorporated by reference. Exfoliation member 24 can be, for example, a mounted abrasive (e.g., sandpaper), a composite containing engineered fibers, a brush (with or without abrasive elements on the brush fibers), a molded surface (e.g., a roughened molded surface), wire mesh, a roughened (e.g., etched) metal surface, stone or stone-like material (e.g., pumice), individual fingers (e.g., plastic fingers), individual knobs, a spray- or dip-coated surface, flocked foam, a woven surface (e.g., terrycloth), or the hook and/or loop component of a hook-and-loop fastener (e.g., a Velcro™ fastener).

Exfoliation member 24 includes an exposed portion 28, and an enclosed portion 30. Exposed portion 28 is located on the surface of cartridge 12, such that it, like blades 18 and guard 20, is adapted to make contact with the user's skin during shaving. Enclosed portion 30 is located within housing 16. Some of the enclosed portion may become exposed during adjustment, as will be discussed below.

Exfoliation member 24 can be adjusted by a manual adjustment mechanism. In FIG. 2, manual adjustment mechanism 32 includes a screw 34 threaded into a holder 35, and a cam 36, which is connected to screw 34. Cam 36 is disposed within a space 38 in enclosed portion 30 of exfoliation member 24. A wave spring 37 biases exfoliation member 24 upward and can stabilize the exfoliation member when the-user exerts pressure against a portion of its surface. Wave spring 37 can stabilize exfoliation member 24 by exerting a distributed restoring force over the length and the width of the exfoliation member. Furthermore, wave spring 37 can help to prevent exfoliation member 24 from binding or sticking in housing 16. Although a wave spring is shown in FIG. 2, in some cases the exfoliation member can be biased upward by, for example, a foam pad or molded chevrons.

Figure 2A:
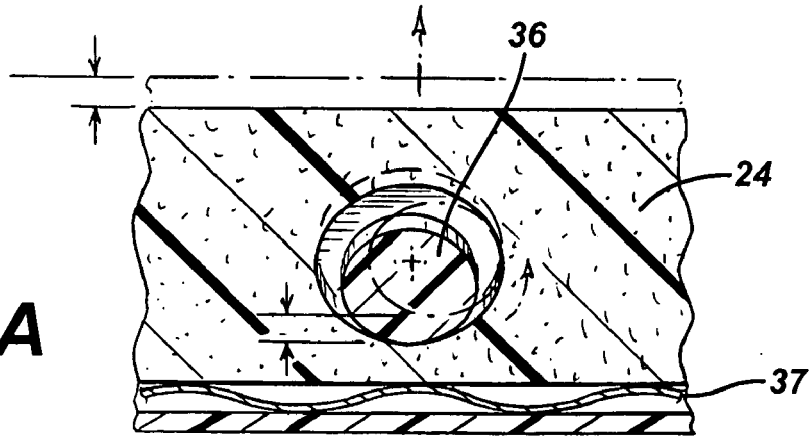
FIG. 2A is a cross-sectional view of a portion of the cartridge of FIG. 2, taken along line 2A—2A.

Referring also now to FIG. 2A, as the user manually turns screw 34 by between about zero and about 360 degrees, cam 36 rotates, pushing against exfoliation member 24 and thereby causing it to move transversely, over a distance D. The surface area of exposed portion 28 of exfoliation member 24 increases or decreases as cam 36 turns, depending on the position of cam 36 within space 38. The position of the exposed portion relative to the user's skin also changes as the cam turns. When the exfoliation member is maximally displaced (i.e., when it has been displaced by distance D), the user will experience the greatest amount and intensity of exfoliation. As exfoliation member 24 is returned back to its original position, the user will experience a decreased amount and intensity of exfoliation. Thus, by adjusting exfoliation member 24, the user can adjust the amount and/or force of contact between the exfoliation member and the skin.

Figure 2B:
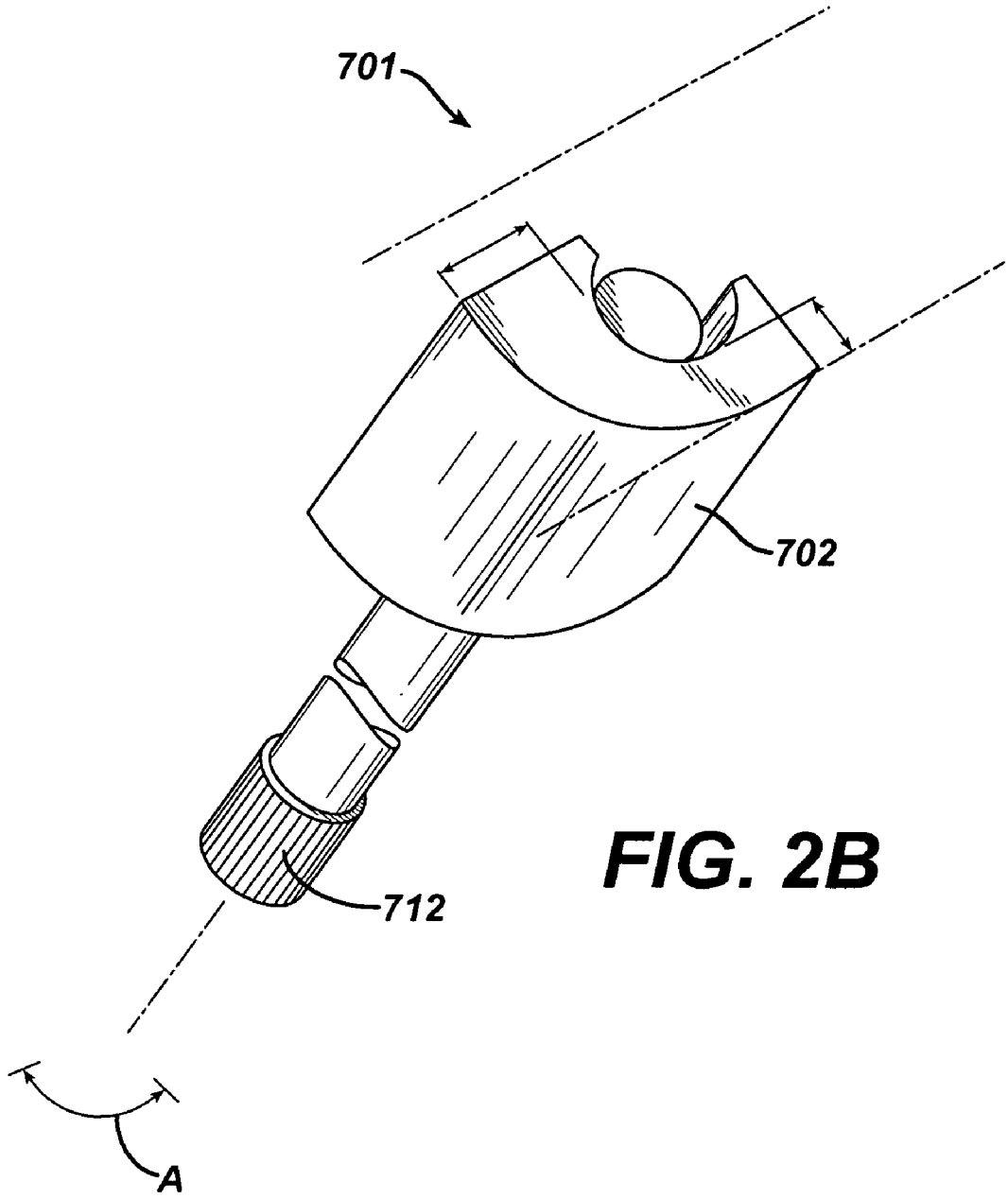
FIG. 2B is a perspective view of an adjustment mechanism.
Figure 2C:
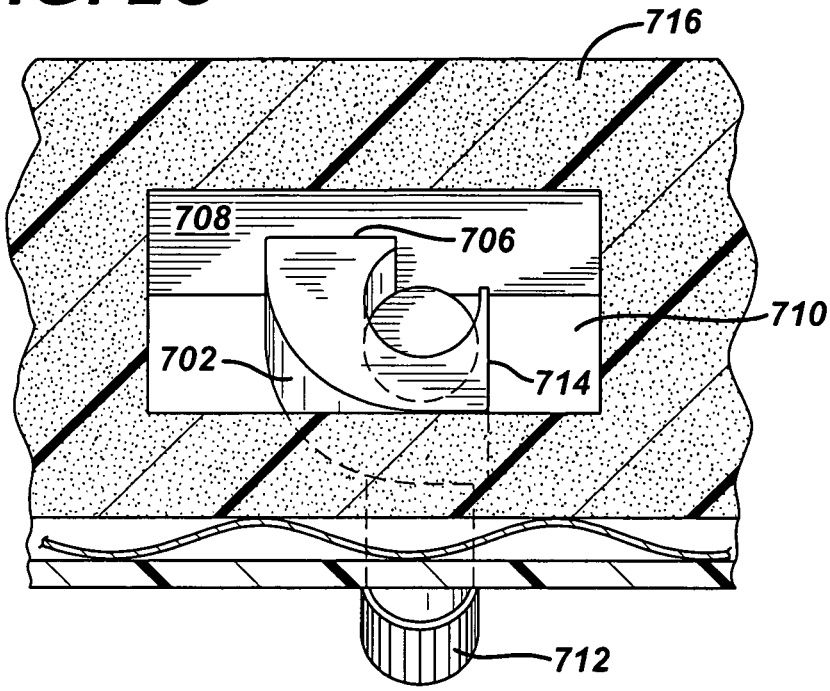
FIGS. 2C and 2D are perspective views in partial cross-section of the adjustment mechanism of FIG. 2B.
Figure 2D:
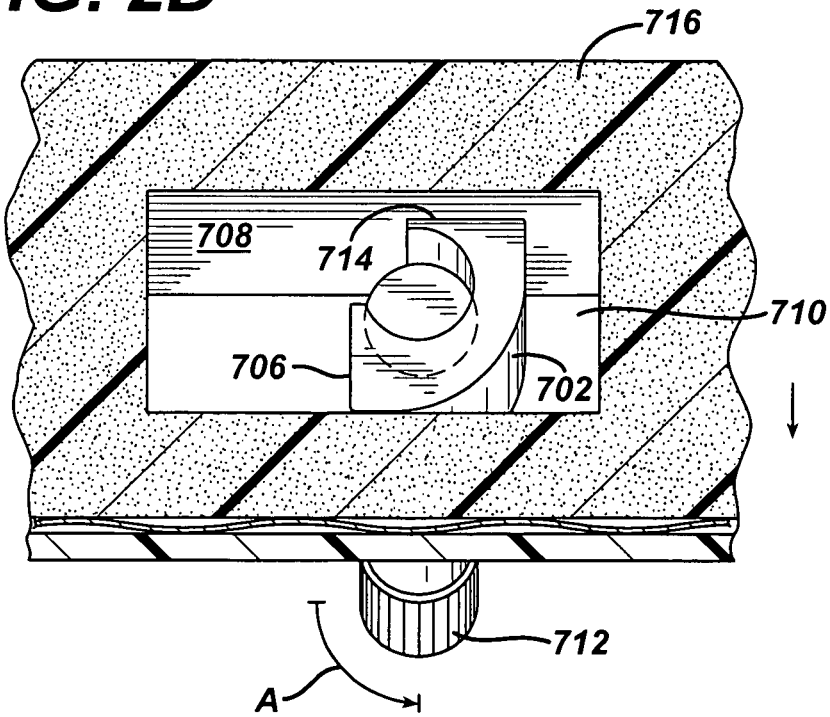

The cam need not have the shape that it has in FIGS. 2 and 2A, however. For example, in FIGS. 2B–2D, a manual adjustment mechanism 701 includes a wedge-shaped cam 702 with a curved surface and two substantially perpendicular flat sides 706 and 714. The wedge shape of cam 702 actuates exfoliation member 716 up or down. Because of sides 706 and 714, the cam is only able to rotate about 90 degrees before it is stopped from rotating further. In FIG. 2C, side 706 of cam 702 is at rest against a wall 708 that defines a space 710 within exfoliation member 716. Referring now to FIG. 2D, as the user manually turns screw 712 in the direction indicated by arrow A, side 706 loses contact with wall 708. After cam 702 has turned approximately 90 degrees, side 714 of the cam makes contact with wall 708. Thus, the exfoliation member 716 moves up and down within a distance determined by the limits imposed by the wedge shape of cam 702. One advantage to such an arrangement is that it can allow the user to know when he or she has reached minimum and maximum points of exfoliation.

In some embodiments, and referring now to FIGS. 2E and 2F, a manual adjustment mechanism 750 includes a faceted cam 754 with three generally flat surfaces 758, 759, and 762. As the user turns screw 766, the user can sense when the exfoliation member 770 is at a point of minimum exfoliation, a point of maximum exfoliation, and a point of intermediate exfoliation. While the faceted cam of FIGS. 2E and 2F has three generally flat surfaces, in other embodiments it can have more than three generally flat surfaces (e.g., three, four, five, six generally flat surfaces). With such a cam, the user can determine when he or she has reached different levels of exfoliation.

Although the manual adjustment mechanisms of FIGS. 2–2F each include a screw and a cam, many different types of manual adjustment mechanisms are possible. For example, in FIG. 3 cartridge 12 has a manual adjustment mechanism 40 which includes a slide actuator 42. Slide actuator 42 has a knob 46 which is connected to one end of a link 48. Link 48 fits within slot 44, and is connected at its other end to exfoliation member 24. Slot 44 has a diagonal shape. Thus, as the user moves slide actuator 42 diagonally within slot 44 (as indicated by the arrows Al), exfoliation member 24 moves transversely, in the direction of arrows A2. Manual adjustment mechanism 40 can provide the user with a relatively unobtrusive means of adjusting exfoliation member 24. In some cases, a biasing means such as a spring (not shown) can be disposed beneath exfoliation member 24. The biasing means can stabilize the exfoliation member by causing the exfoliation member to fit more tightly into housing 16. In certain embodiments, push-by detents can help to keep the exfoliation member in position. For example, slot 44 can include detents so that slide actuator 42 does not move as easily and/or quickly within slot 44 as it does when the slot does not include detents.

Figure 4:
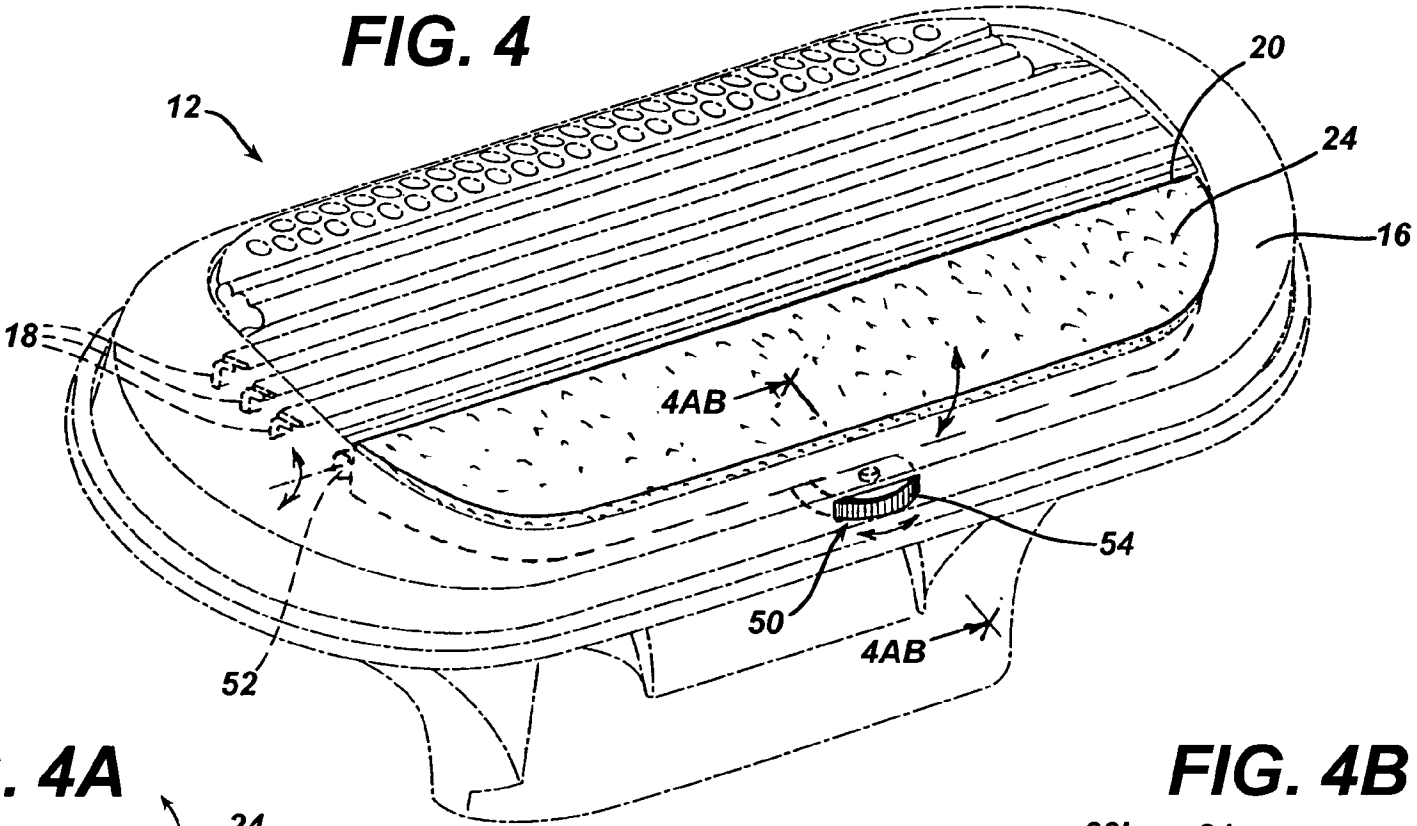
FIG. 4 is a perspective view of a cartridge.
Figure 4B:
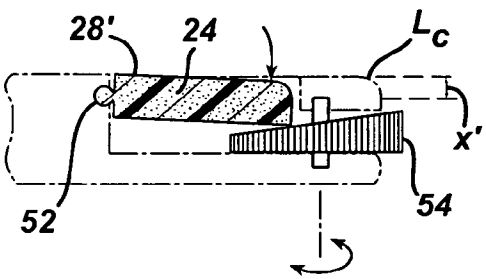
FIG. 4B is a cross-sectional view of a portion of the cartridge of FIG. 4, taken along line 4AB—4AB, when the cartridge is in a second position.
Figure 4A:
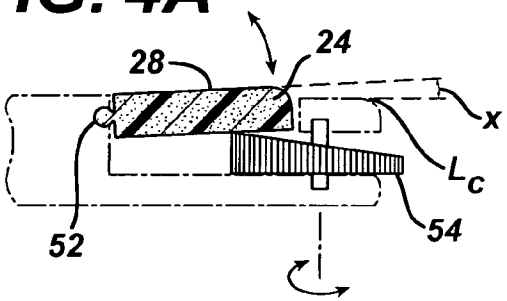
FIG. 4A is a cross-sectional view of a portion of the cartridge of FIG. 4, taken along line 4AB—4AB, when the cartridge is in a first position.

Referring now to FIG. 4, another embodiment of a manual adjustment mechanism is shown. Manual adjustment mechanism 50 includes a pivot 52 and a wheel actuator 54. As shown in FIGS. 4A and 4B, wheel actuator 54 is thicker in some areas than in others. Thus, as the user dials wheel actuator 54, exfoliation member 24 moves up or down, depending on the thickness of the portion of wheel actuator 54 beneath the exfoliation member. In FIG. 4A, the thickest portion of wheel actuator 54 is beneath exfoliation member 24, so that the exfoliation member is disposed in its uppermost position. In FIG. 4B, the thinnest portion of wheel actuator 54 is beneath exfoliation member 24, so that the exfoliation member is disposed in its lowermost position.

Pivot 52 provides a point of rotation, allowing exfoliation member 24 to shift upward or downward in a type of flapping motion. As the exfoliation member shifts, the angle between exfoliation member 24 and leading skin-engaging surface $L_C$ of cartridge housing 16 changes. In FIG. 4A, angle X between the exfoliation member and leading skin-engaging surface $L_C$ is positive because the plane of the exfoliation member is disposed above leading skin-engaging surface $L_C$. In FIG. 4B, angle X' between the exfoliation member and leading skin-engaging surface $L_C$ is negative because the plane of the exfoliation member is disposed below leading skin-engaging surface $L_C$. Thus, exposed portion 28 of exfoliation member 24 in FIG. 4A has a greater surface area than exposed portion 28' of exfoliation member 24 in FIG. 4B.

Angles X and X' can be between about −15 degrees and about 15 degrees (e.g., about 7 degrees, about −7 degrees). When exfoliation member 24 and leading skin-engaging surface $L_C$ are oriented according to FIG. 4A (i.e., at angle X relative to each other), the user generally will experience a relatively high amount of exfoliation. When exfoliation member 24 and leading skin-engaging surface $L_C$ are oriented according to FIG. 4B (i.e., at angle X' relative to each other), the user generally will experience a relatively low amount of exfoliation. Thus, by adjusting the angle between the exfoliation member and the leading skin-engaging surface of the cartridge housing, the user can adjust the degree of exfoliation to suit his or her preferences.

Figure 5:
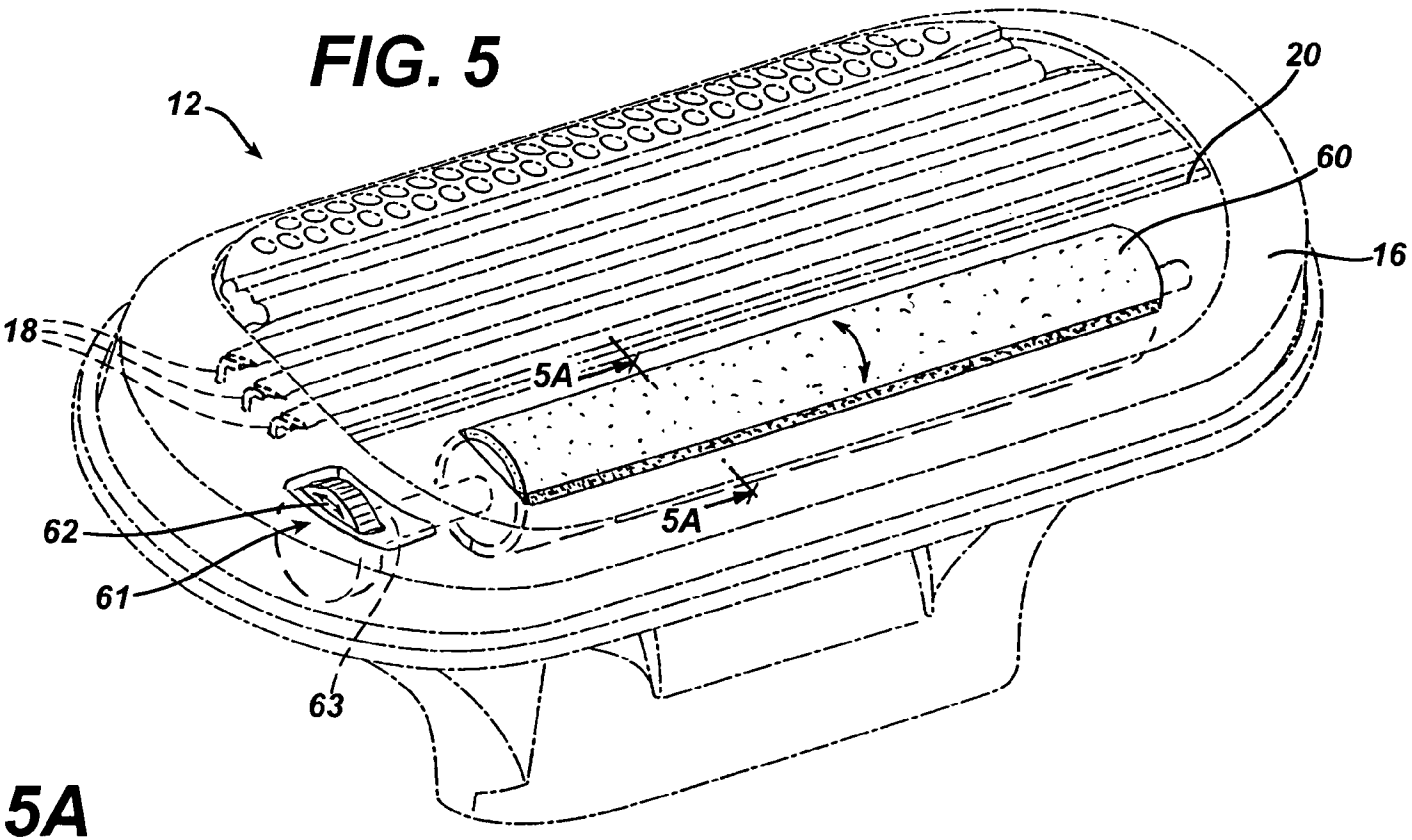
FIG. 5 is a perspective view of a cartridge.

In FIG. 5, exfoliation member 60 is a cylindrical roller, and is rotatable by a manual adjustment mechanism 61 that includes a wheel 62. Wheel 62 is disposed within a recess 63 in cartridge housing 16. In some cases, the position of the wheel in FIG. 5 may cause the wheel to be inadvertently engaged and rotated during shaving. Thus, if desired, cartridge 12 can include, for example, detents, a friction clutch, and/or other means of decreasing the likelihood of accidental engagement and rotation of wheel 62. In certain embodiments, wheel 62 can be positioned in a location on cartridge 12 that is different from the position of wheel 62 shown in FIG. 5.

Figure 5A:
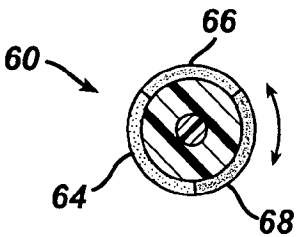
FIG. 5A is a cross-sectional view of a portion of the cartridge of FIG. 5, taken along line 5A—5A.

Referring also now to FIG. 5A, exfoliation member 60 has distinct portions 64, 66, and 68. When the user rotates exfoliation member 60 by means of wheel 62, the portion or portions of exfoliation member 60 that are exposed to the user's skin can change. For example, using wheel 62, the user can rotate exfoliation member 60 so that portion 66, which originally was exposed to the user's skin, is hidden, and portion 68 is now exposed to the user's skin.

Portions 64, 66, and 68 can include different numbers of exfoliating elements. For example, portion 64 can include a relatively small number of exfoliating elements, and can correspondingly provide a low level of exfoliation. At the same time, portion 66 can have an intermediate number of exfoliating elements, and can thereby provide an intermediate level of exfoliation. Meanwhile, portion 68 can have a high number of exfoliating elements, and can provide a relatively high level of exfoliation. Thus, the user can vary the amount of contact between exfoliation member 60 and the skin by dialing wheel 62 to obtain exposure to the portion that best suits the user's desired amount of exfoliation.

In some cases, portions 64, 66, and 68 can include different types of exfoliating elements, to provide different levels of exfoliation. For example, portion 64 can include ground fruit seeds (e.g., ground apricot seeds), while portion 66 includes ground nut shells (e.g., ground walnut shells), and portion 68 includes ground or fibrous plant material (e.g., loofah).

In certain embodiments, different portions of exfoliation member 60 can include different colorants. For example, a portion with relatively low exfoliating power can be white, while a portion with intermediate exfoliating power is light blue, and a portion with high exfoliating power is dark blue. In some cases, the color of a portion can indicate the type of exfoliating elements that are present in that portion. For example, a portion containing avocado seeds can be green in color.

While three distinct portions of exfoliation member 60 are shown in FIGS. 5 and 5A, the exfoliation member can have a higher or lower number of distinct exfoliation portions (e.g., one distinct portion, two distinct portions, four distinct portions, five distinct portions, six distinct portions).

Figure 6:
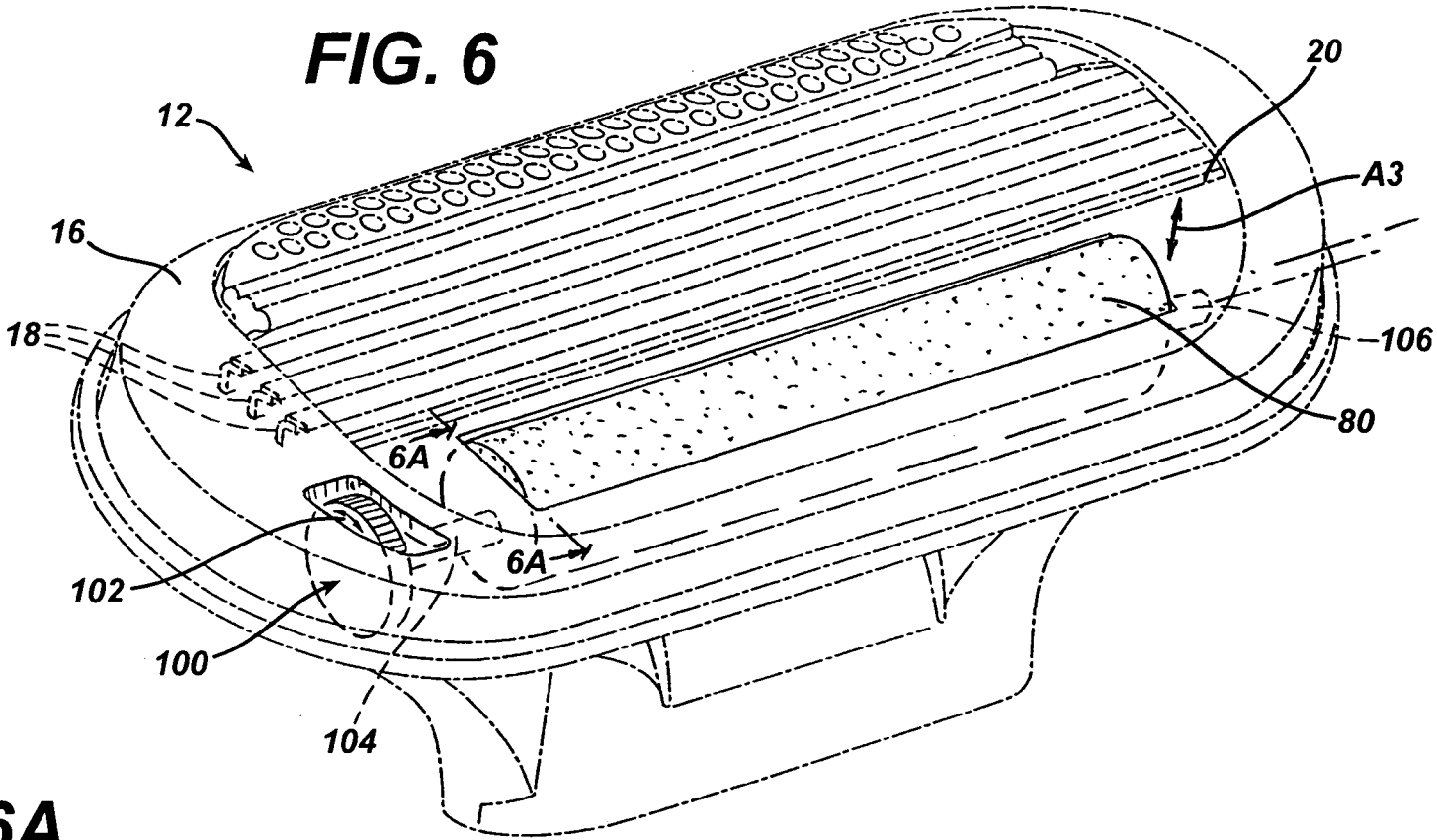
FIG. 6 is a perspective view of a cartridge.
Figure 6A:
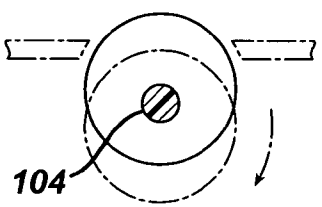
FIG. 6A is a cross-sectional view of a portion of the cartridge of FIG. 6, taken along line 6A—6A.

Referring now to FIG. 6, another manual adjustment mechanism is shown. In FIG. 6, exfoliation member 80 is, like exfoliation member 60 of FIG. 5, a cylindrical roller. However, exfoliation member 80 has generally the same density of exfoliating elements along the entirety of its surface. A manual adjustment mechanism 100 includes a wheel 102 connected to a first eccentric shaft 104 (FIG. 6A), which in turn is connected to one side of exfoliation member 80. On the other side of exfoliation member 80, a second eccentric shaft 106 is connected to the exfoliation member at one end and to housing 16 at the other end. As the user turns wheel 100, exfoliation member 80 moves transversely, in the direction indicated by arrows A3. Thus, the user can manually vary the degree and extent of exfoliation. As discussed above with reference to FIG. 5, if desired, cartridge 12 can include, for example, detents, a friction clutch, and/or other means of decreasing the likelihood of accidental engagement and rotation of wheel 100. In certain embodiments, wheel 100 can be positioned in a location on cartridge 12 that is different from that shown in FIG. 6.

The above cartridge embodiments all have exfoliation members that are located in front of the blades (i.e., so that the user's skin generally will make contact with the exfoliation member before making contact with the blades). Such a location for the exfoliation member can allow a user good control of exfoliation. In some cases, the user can manipulate and control the location and pressure of exfoliation more easily than if the exfoliation member were located elsewhere. When the exfoliation member is located in front of the blades, it can help guard 20 to stretch the skin and/or extend the hairs for easier shaving. In some cases in which the exfoliation member is located in front of the blades, space after the blades can be available for, e.g., a lubricating or moisturizing shaving aid matrix (described infra) that can be absorbed into the skin after shaving.

Figure 7:
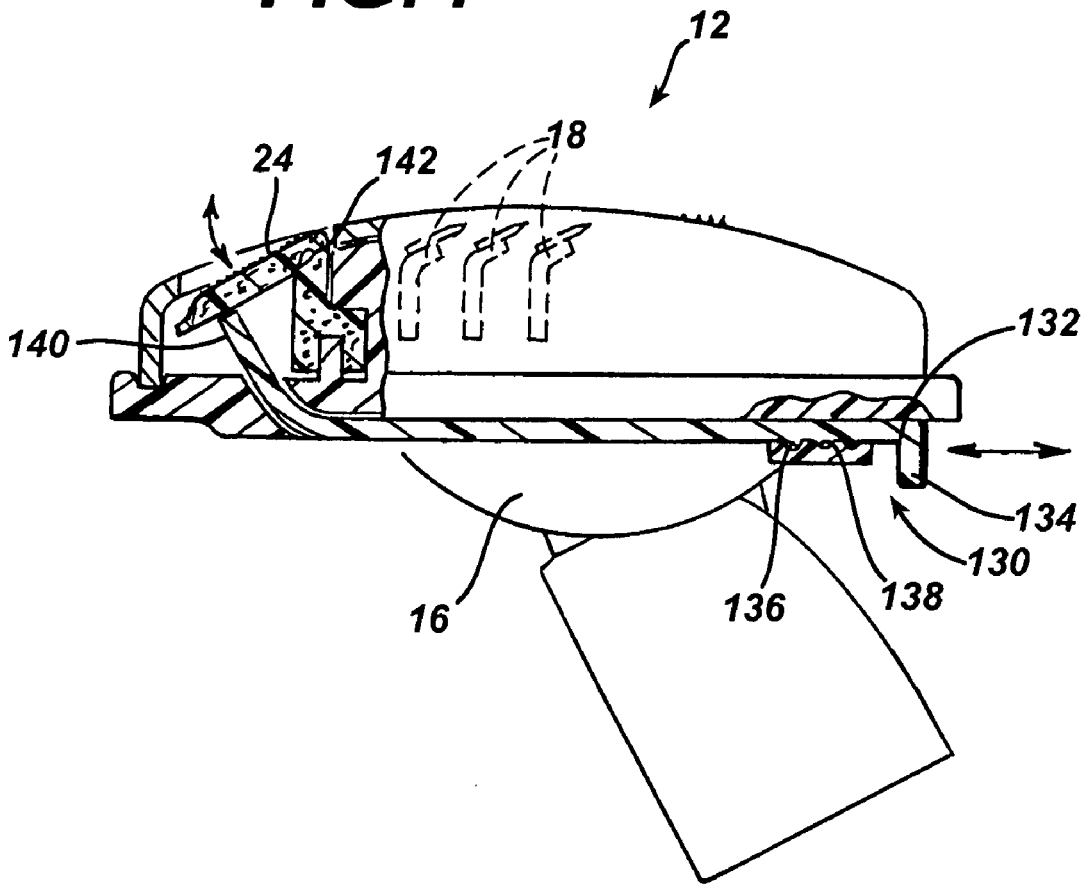
FIG. 7 is a side view in partial cross-section of a cartridge.

Although the cartridge embodiments shown above have exfoliation members located in front of the blades, other geometries are possible. For example, FIG. 7 shows an embodiment of a cartridge in which exfoliation member 24 is arranged behind blades 18. Thus, when the user shaves with the razor, the user's skin will generally make contact with blades 18 before making contact with exfoliation member 24. When the exfoliation member is arranged behind the blades, space before the blades can be used for other skin care features (such as a lubricating or moisturizing shaving aid matrix, described infra). Additionally, an exfoliation member that is located behind the blades can blunt or otherwise smoothen the edges of hairs that have just been cut by the blades. Furthermore, when the exfoliation member is located behind the blades, it can help to clean and/or smoothen skin after shaving.

In FIG. 7, a manual adjustment mechanism 130 includes a pusher 132 with an actuation tab 134 and detents 136. Detents 136 engage grooves 138 in cartridge housing 16. Pusher 132 is sloped at one end to form a tip 140 which contacts exfoliation member 24. Exfoliation member 24 is mounted on one end of a living hinge 142, so that the exfoliation member follows the motion of the living hinge. When the user moves pusher 132 horizontally (as shown by the arrows), exfoliation member 24 correspondingly moves up or down, pivoting at the point of living hinge 142.

Figure 8:
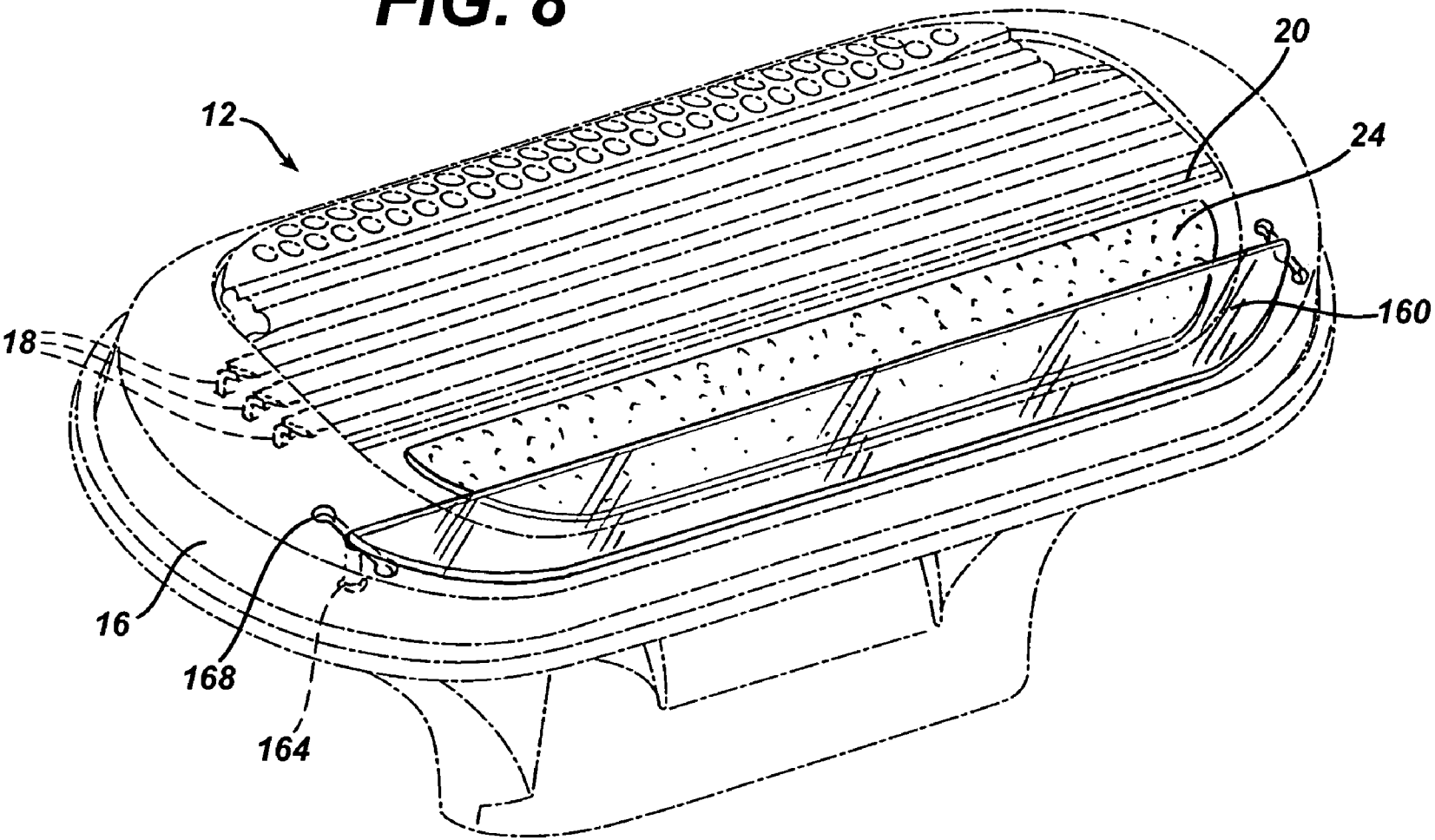
FIG. 8 is a perspective view of a cartridge.

Referring to FIG. 8, in some cases the manual adjustment mechanism for exfoliation member 24 is a cover that can shelter part, all, or none of exfoliation member 24. In FIG. 8, exfoliation member 24 includes an adjustable cover 160. Cover 160 can be made of, for example, a transparent material (e.g., a transparent plastic, such as polypropylene), so that the user can see the extent to which the exfoliation member is covered. Cover 160 is adjusted by means of a lever 164, which is disposed in a notched slot 168. The user can adjust the position of lever 164 within notched slot 168, in order to alter the degree of coverage of exfoliation member 24 by cover 160. Thus, the user can adjust the amount of contact between exfoliation member 24 and the skin. Cover 160 can be used to protect exfoliation member 24 when wet-shaving system 10 is not in use.

Figure 9:
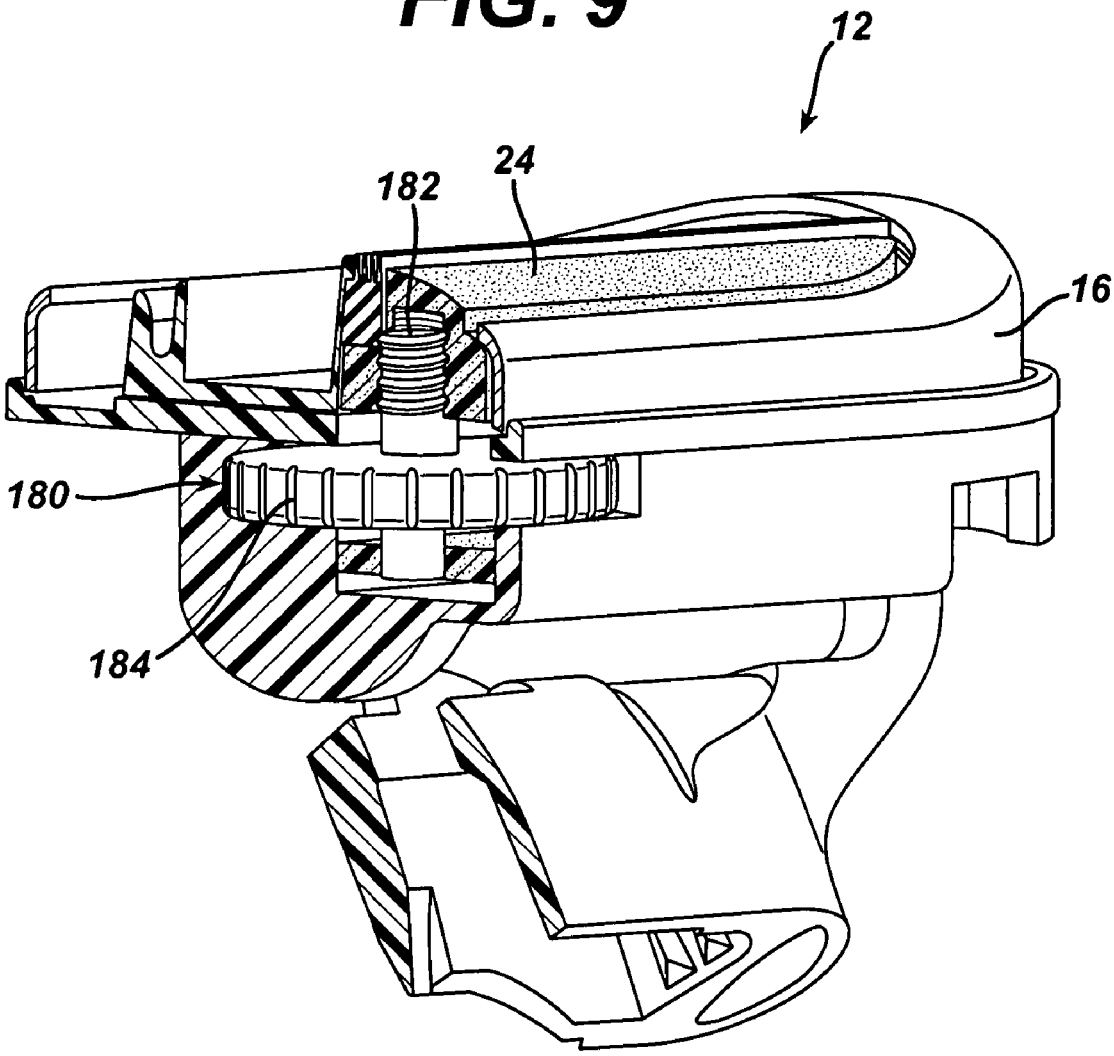
FIG. 9 is a perspective view in partial cross-section of a cartridge.
Figure 9A:
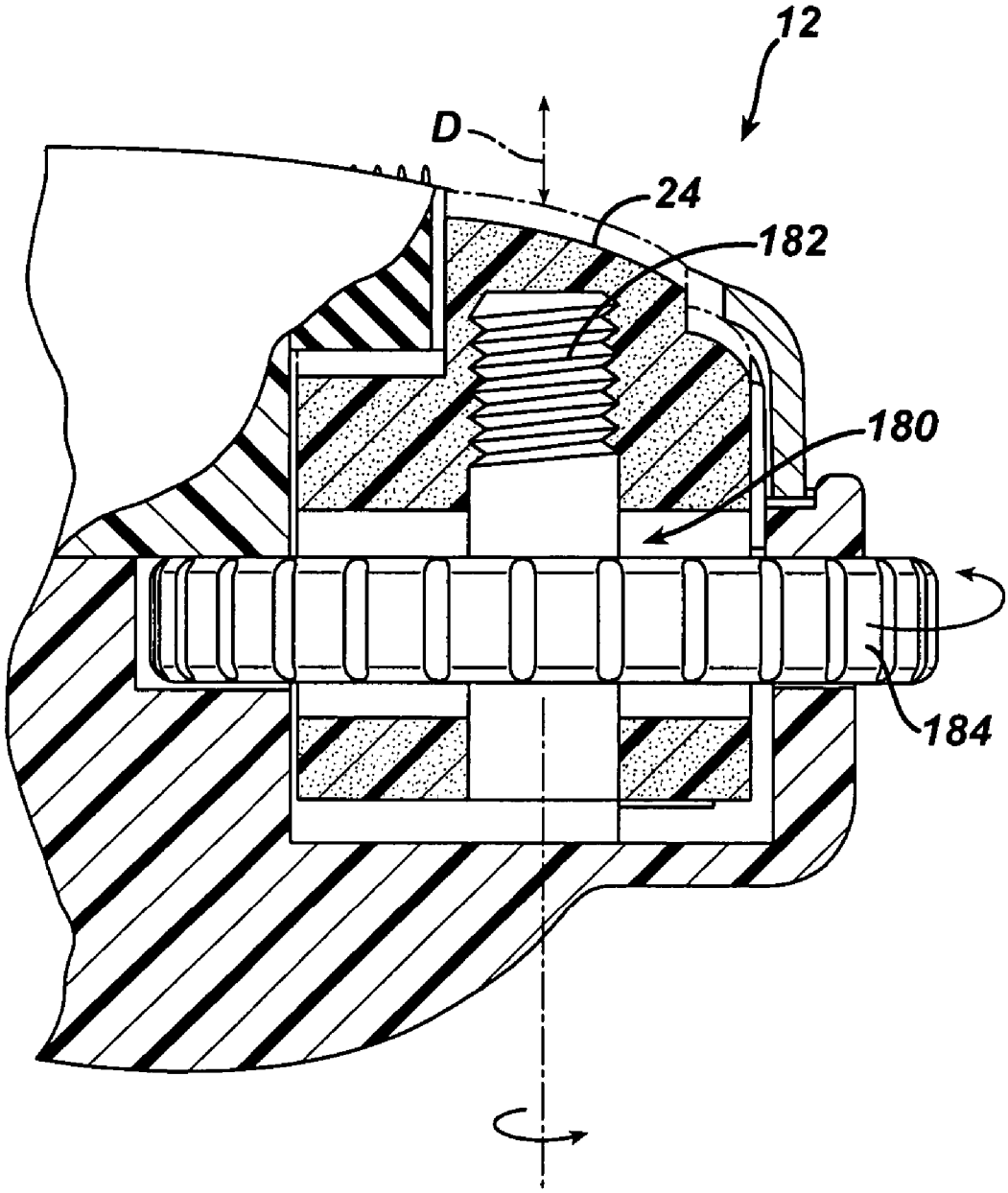
FIG. 9A is a side view in partial cross-section of a portion of the cartridge of FIG. 9.

Referring now to FIGS. 9 and 9A, another embodiment of a manual adjustment mechanism is shown. In FIGS. 9 and 9A, manual adjustment mechanism 180 includes a post 182 that is fixed relative to a thumb wheel 184. A portion of post 182 is threaded and fits within a corresponding threaded section of exfoliation member 24. As the user dials thumb wheel 184, post 182 moves, causing exfoliation member 24 to move up or down.

Figure 9B:
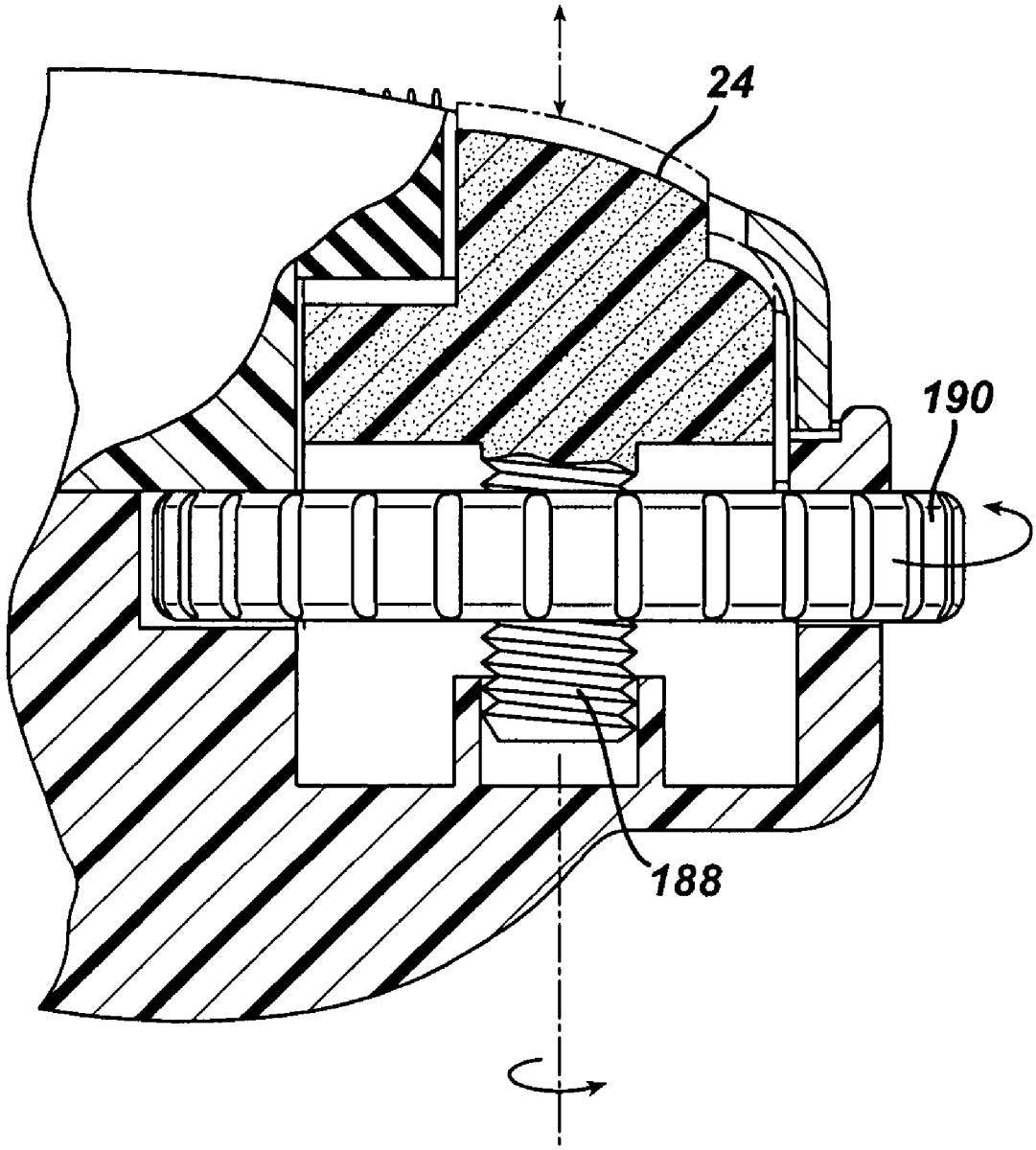
FIG. 9B is a side view in partial-cross section of an adjustment mechanism.

Although post 182 of FIGS. 9 and 9A is only partially threaded, in some cases, it can be threaded along its entire length. For example, as shown in FIG. 9B, the interior surface of the thumb wheel also can be threaded, and the exfoliation member can be fixedly attached to the post. As the user turns the thumb wheel, the post moves up and down, thereby causing the exfoliation member to move, as well. Thus, in this embodiment, the exfoliation member remains fixed relative to the post (while in the embodiment of FIGS. 9 and 9A, the exfoliation member moves up and down along the post).

Figure 9C:
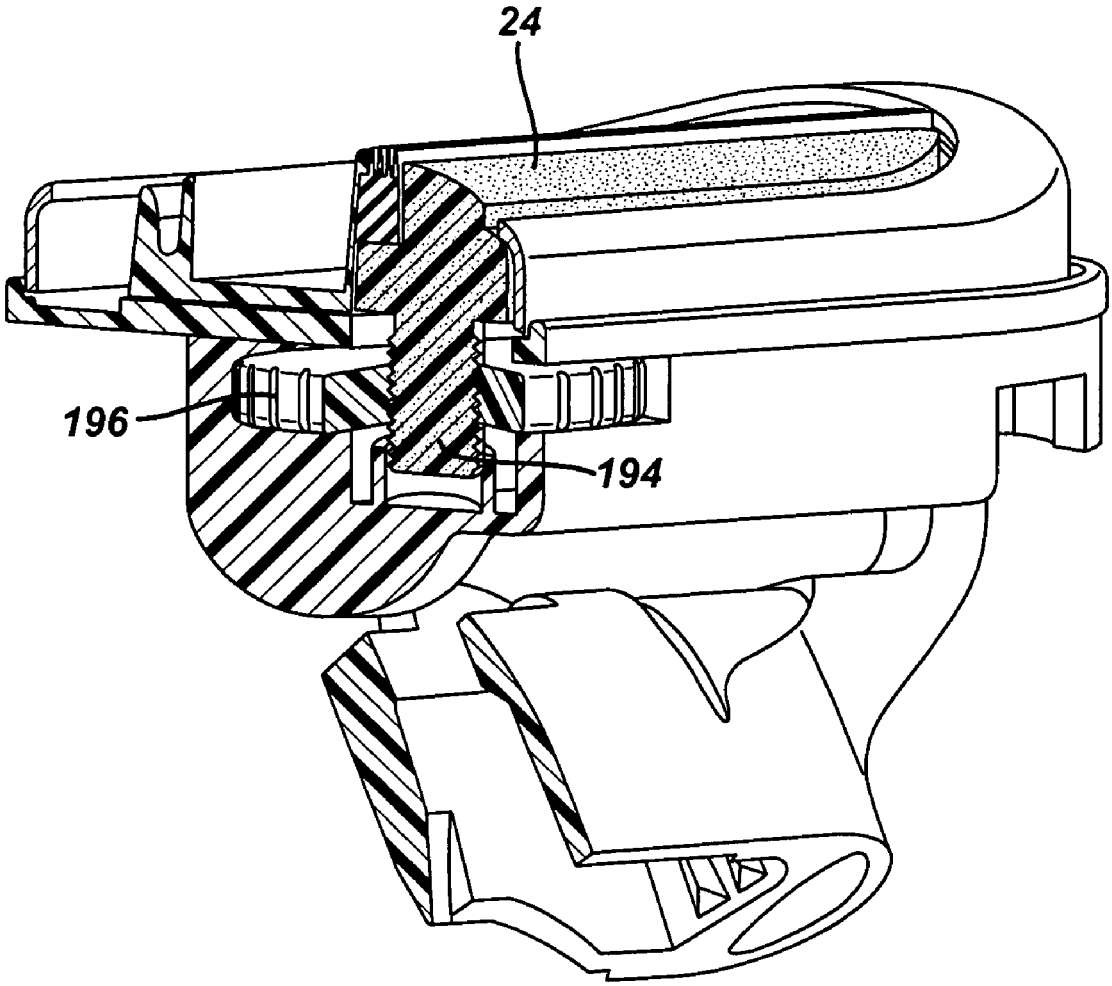
FIG. 9C is a perspective view in partial-cross section of an adjustment mechanism.

Referring now to FIG. 9C, in some cases the exfoliation member itself can form the post. In FIG. 9C, exfoliation member 24 includes a portion that forms a post 194. As the user dials thumb wheel 196, post 194 (and, therefore, the entirety of exfoliation member 24) moves up and down.

While the adjustment mechanisms shown above with reference to FIGS. 1–9C are manual adjustment mechanisms, in some cases the exfoliation members can be adjusted automatically, to vary the amount and/or force of contact between the exfoliation members and the user's skin.

Figure 10:
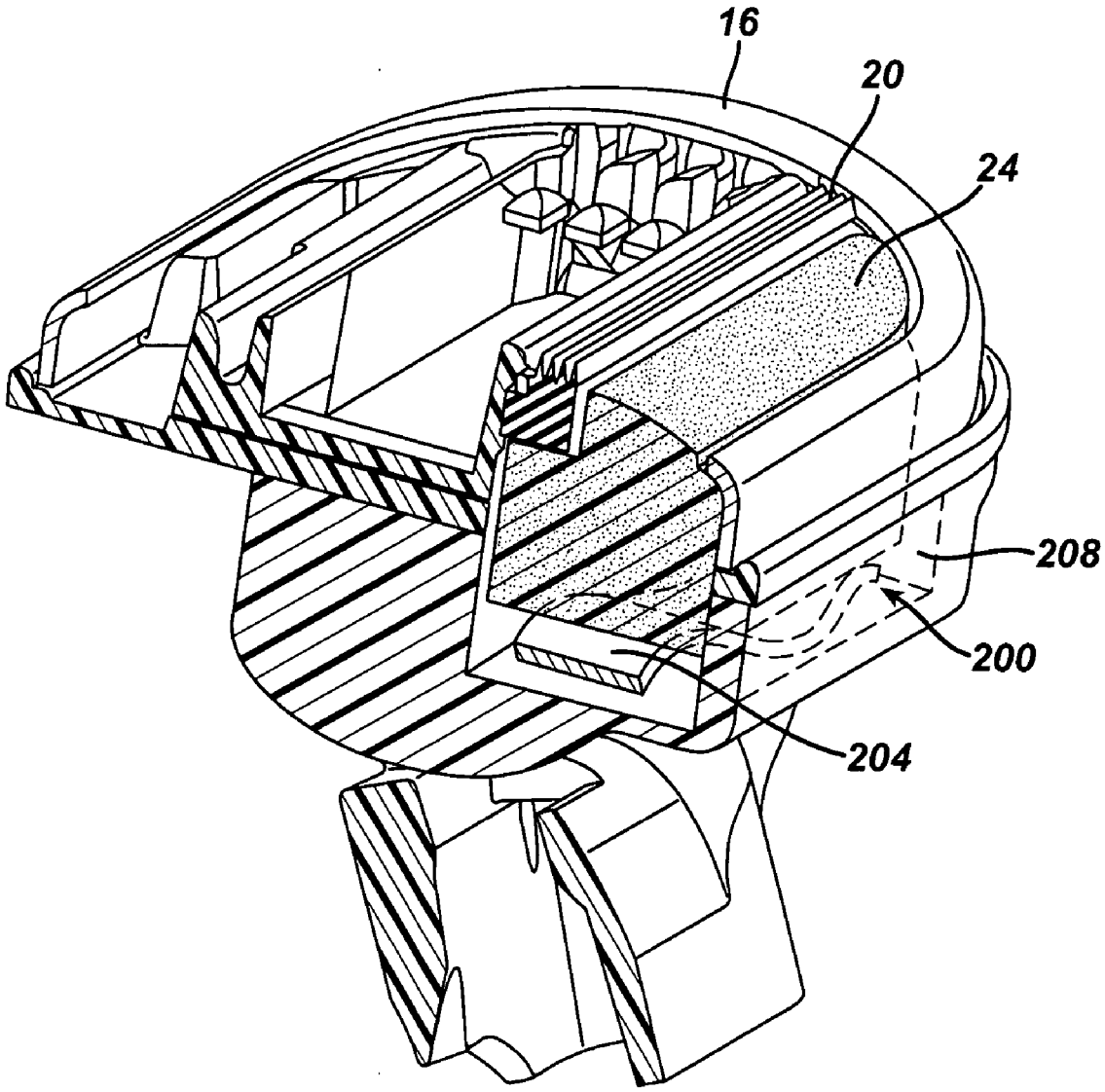
FIG. 10 is a perspective view of a cartridge.

For example, and referring now to FIG. 10, an automatic adjustment mechanism 200 includes a wave spring 264 located in a space 208 in housing 16, underneath exfoliation member 24. Wave spring 204 can be made of a resilient material (e.g., spring steel). Wave spring 204 can act as a relief, preventing the user from exerting too much pressure against the skin during exfoliation. In other words, wave spring 204 can allow exfoliation member 24 to become recessed in housing 16. Thus, the user can be prevented from experiencing overly aggressive exfoliation (e.g., relative to the exfoliation the user may experience when using a fixed exfoliation pad). Although a wave spring is shown in FIG. 10, in some cases adjustment mechanism 200 can include, e.g., a resilient foam (having, for example, a closed cell or open cell foam), or chevrons that are integral with the base of exfoliation member 24.

Figure 11:
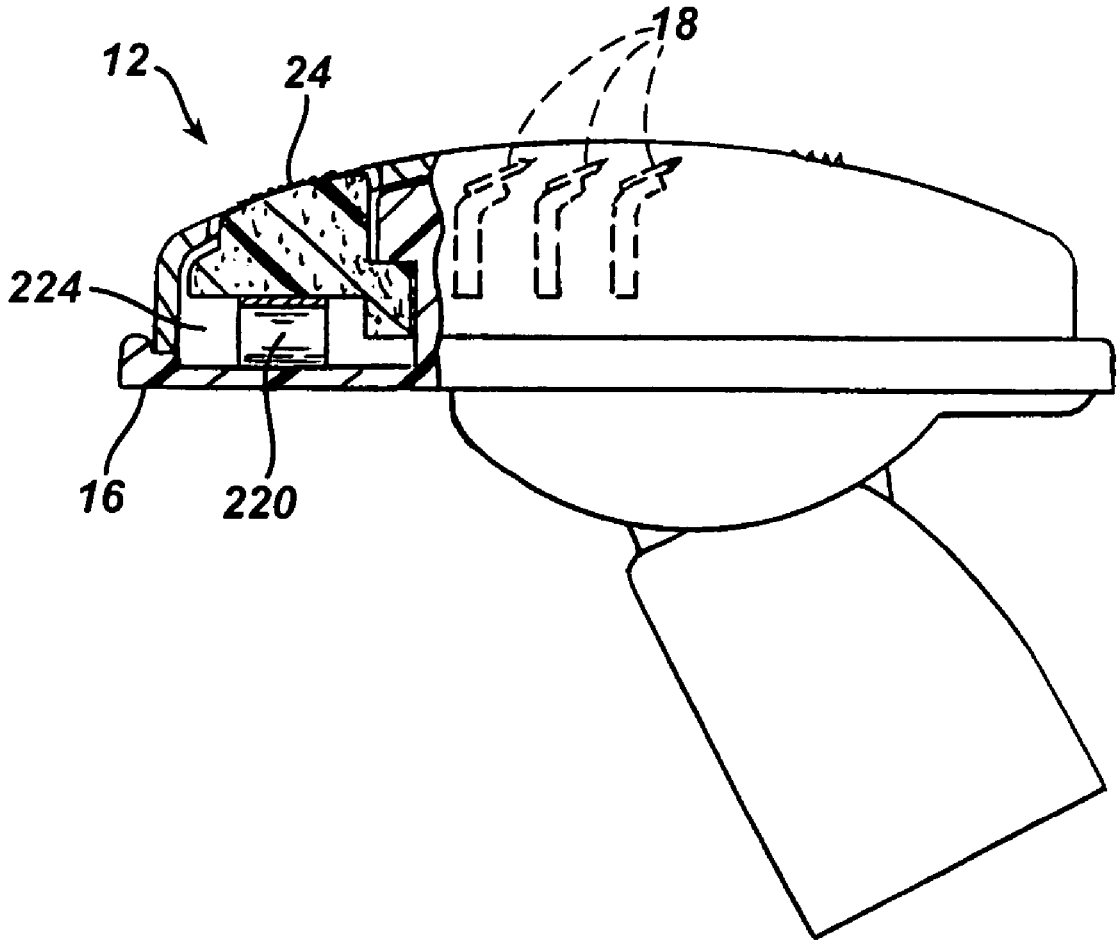
FIG. 11 is a side view in partial cross-section of a cartridge.

FIG. 11 shows an embodiment of a cartridge similar to that shown with reference to FIG. 10. In FIG. 11, cartridge 12 includes a wave spring 220 located in a space 224 in housing 16, beneath exfoliation member 24. However, in FIG. 11 exfoliation member 24 is arranged after blades 18, such that when the user shaves with the razor, the user's skin will generally make contact with blades 18 before making contact with exfoliation member 24.

Figure 12:
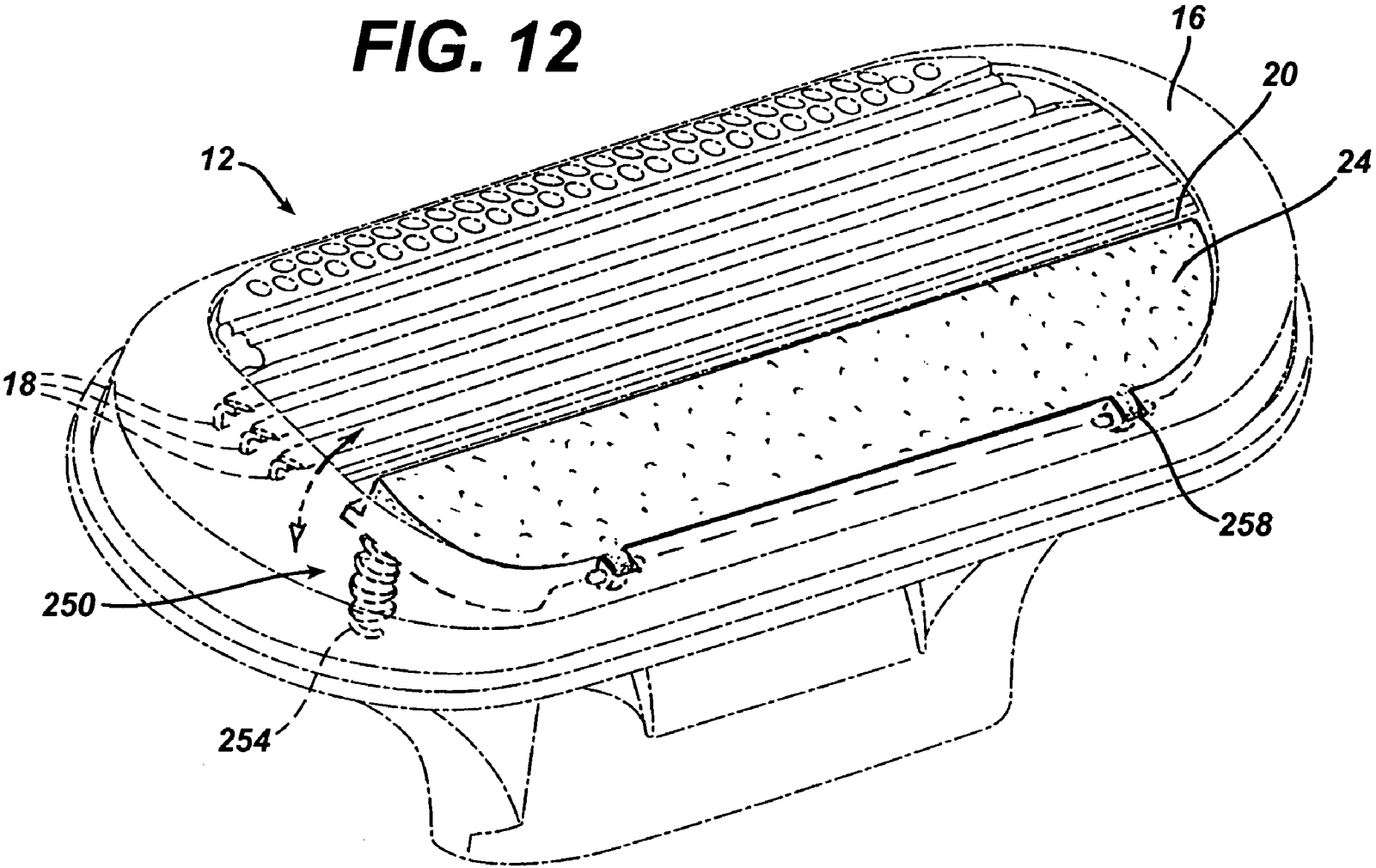
FIG. 12 is a perspective view of a cartridge.

An automatic adjustment mechanism need not be a wave spring, however. Different types of springs and spring-like mechanisms are suitable for use with exfoliation member 24. In FIG. 12, for instance, an automatic adjustment mechanism 250 includes a coil spring 254 disposed underneath a portion of exfoliation member 24. Exfoliation member 24 is attached to housing 16 via hinges 258. As the user presses exfoliation member 24 against his or her skin, coil spring 254 mitigates the action of the exfoliation member against the skin. Coil spring 254 can be attached to the bottom of exfoliation member 24, or can be integrally molded (e.g., as a chevron or chevrons) with exfoliation member 24. The coil spring can act as a relief, preventing the user from exerting too much pressure against the skin during exfoliation. In other words, coil spring 254 can allow exfoliation member 24 to become recessed in housing 16. Thus, the user can experience less aggressive exfoliation the more the user presses his or her skin against the exfoliation member.

Although wave and coil springs are shown in FIGS. 10–12, other components with spring-like properties can have an effect that is similar to the effect of a wave or coil spring. For example, the adjustment mechanism can be a foam material, such as a polyolefin foam (e.g., Volara®, available from Voltek), a polyethylene foam (e.g., Minicel®, available from Voltek), or a cellular urethane foam (e.g., Poron®, available from Rogers Corporation).

Figure 13:
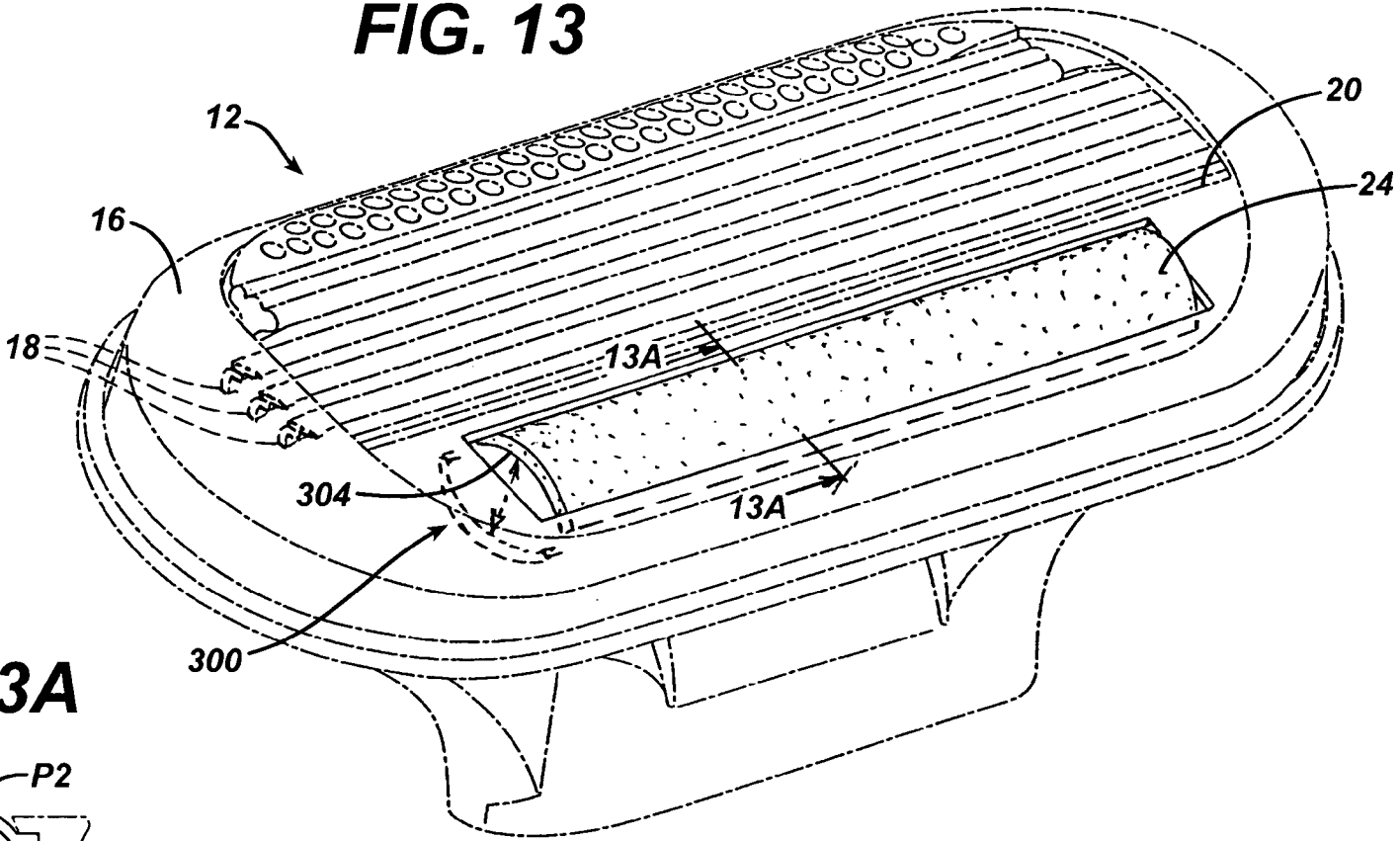
FIG. 13 is a perspective view of a cartridge.
Figure 13A:
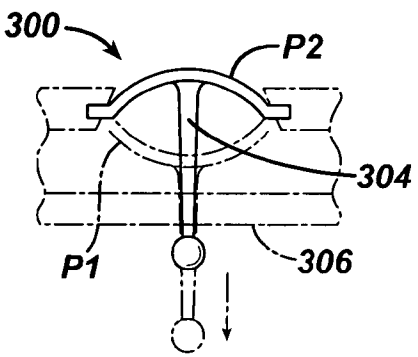
FIG. 13A is a cross-sectional view of a portion of the cartridge of FIG. 13, taken along line 13A—13A.

Another embodiment of an automatic adjustment mechanism is shown in FIGS. 13 and 13A. In FIGS. 13 and 13A, adjustment mechanism 300 includes a rod 304. The rod is connected at one end to exfoliation member 24, which is in the form of a bow plate. At its other end, rod 304 extends through a bottom surface 306 of cartridge housing 16. When the user pulls on rod 304, the exfoliation member snaps into a concave or "off" position P1, such that the user will experience little to no exfoliation. When the user pushes on rod 304, the exfoliation member snaps into a convex or "on" position P2, such that the user will experience exfoliation.

In some cases, the adjustment mechanism for the exfoliation member can be located on the handle portion of the wet-shaving system. In such a system, the user is less likely to accidentally engage the adjustment mechanism during shaving than when the adjustment mechanism is located on the cartridge.

Figure 14:
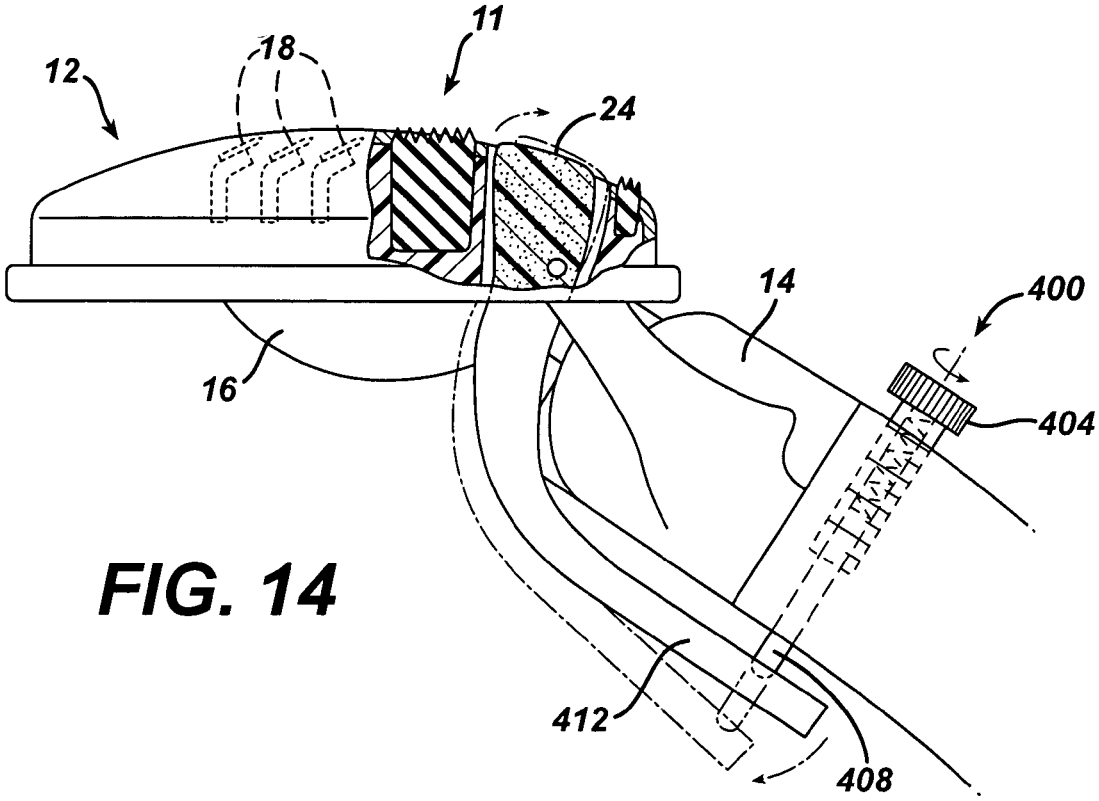
FIG. 14 is a side view in partial cross-section of a shaving system.
Figure 14A:
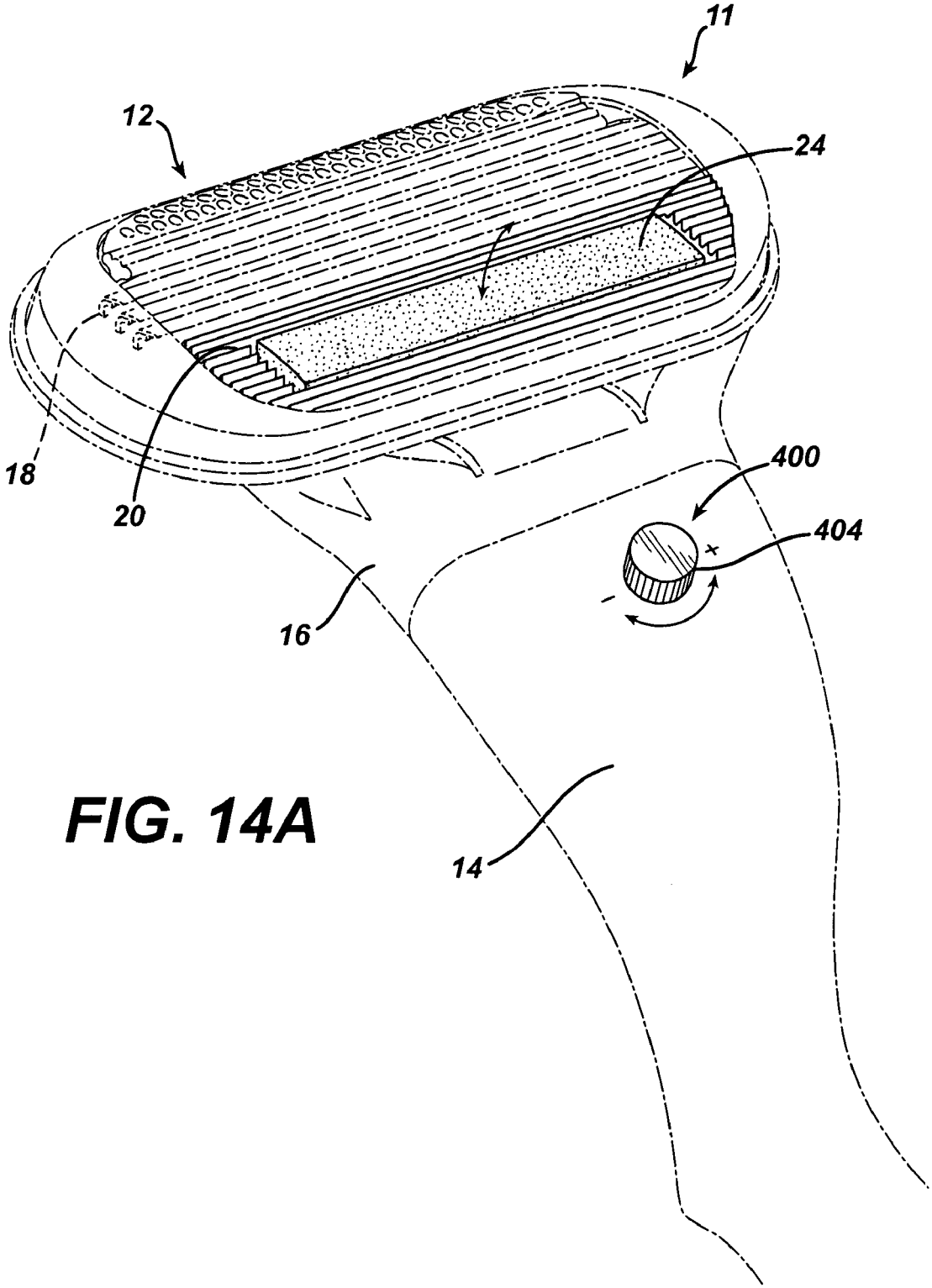
FIG. 14A is a perspective view of the shaving system of FIG. 14.

For example, and referring now to FIGS. 14 and 14A, shaving portion 11 is connected to handle portion 14, and includes cartridge 12. Manual adjustment mechanism 400 includes a screw 404 which is threaded through handle portion 14, and a lever 412 in contact with an end 408 of screw 404. The lever also is in contact with exfoliation member 24. When the user turns screw 404, lever 412 moves and causes exfoliation member 24 to move axially.

In some cases, wet-shaving system 10 can include one exfoliation member on shaving portion 11 and another exfoliation member on handle portion 14. For example, shaving portion 11 can have an exfoliation member with avocado seed granules as exfoliating elements, while handle portion 14 has an exfoliation member with alpha-hydroxy acid microcapsules as exfoliating elements.

The exfoliation member can have any texture that is suitable for exfoliation. The exfoliation member can have a relatively smooth exfoliating texture, such as the texture of a fine non-woven fiber, or it can have a relatively rough exfoliating texture, such as the texture of a pumice stone.

The exfoliating elements in the exfoliation member can be any of a number of different types of exfoliating elements. For example, the exfoliating elements can include abrasive particles, such as ground fruit seeds and stones (e.g., apricot, peach, avocado, or olive seeds or stones), ground nut shells (e.g., walnut, almond, coconut, or pecan shell), ground or fibrous plant material (e.g., loofah, corn cob, oatmeal), polymer beads or granular polymers (e.g., polystyrene beads, polyethylene beads), Jojoba wax beads, rice bran, silica, minerals, granular mineral composites (e.g., sand, pumice sand), clay, or combinations thereof. The exfoliating elements can be dissolvable. The exfoliating elements can be materials (e.g., sea salt) that are abrasive upon first contact with the user's skin, but that later dissolve upon contact with water or shave creams and gels.

In some cases, the exfoliating elements may include chemical exfoliants such as alpha- or beta-hydroxy acids (e.g., citric acid, lactic acid, glycolic acid, tartaric acid). In such cases, the chemical exfoliants can be contained in a microcapsule that breaks during shaving, thereby releasing the exfoliant. In this case, it is generally desirable to use a matrix material that erodes or dissolves during shaving, so that new microcapsules will be exposed to replace those that have ruptured. Suitable microcapsules can range in size from less than about 50 microns to about 1000 microns. Microencapsulation can help to protect the exfoliant, e.g., by protecting heat-sensitive acids from decomposition during extruding or molding operations.

Generally, suitable exfoliating elements have a hardness, roughness, and/or tackiness that is sufficient to allow the exfoliating element to remove loose flakes of skin during shaving. The exfoliating elements can be sufficiently hard so that they do not break down during shaving, or may be softer if desired.

The exfoliation member can have a width of between about 2 mm and about 10 mm, and a length of between about 20 mm and about 40 mm. When the exfoliation member is in the shape of a cylinder, the cylinder can have a diameter of between about 4 mm and about 8 mm. The thickness of the exfoliation member can be between about 0.25 mm and about 10 mm.

The height of the exposed portion of the exfoliation member, relative to the plane along which the leading edges of the blades lie, can be adjusted either upward or downward by an amount of less than about 2 mm, and preferably less than about 1 mm. The angle of the exfoliation member relative to the leading skin-engaging surface of the cartridge housing can be adjusted by an amount of between about −15 degrees and about 15 degrees.

Other embodiments are possible.

Figure 15:
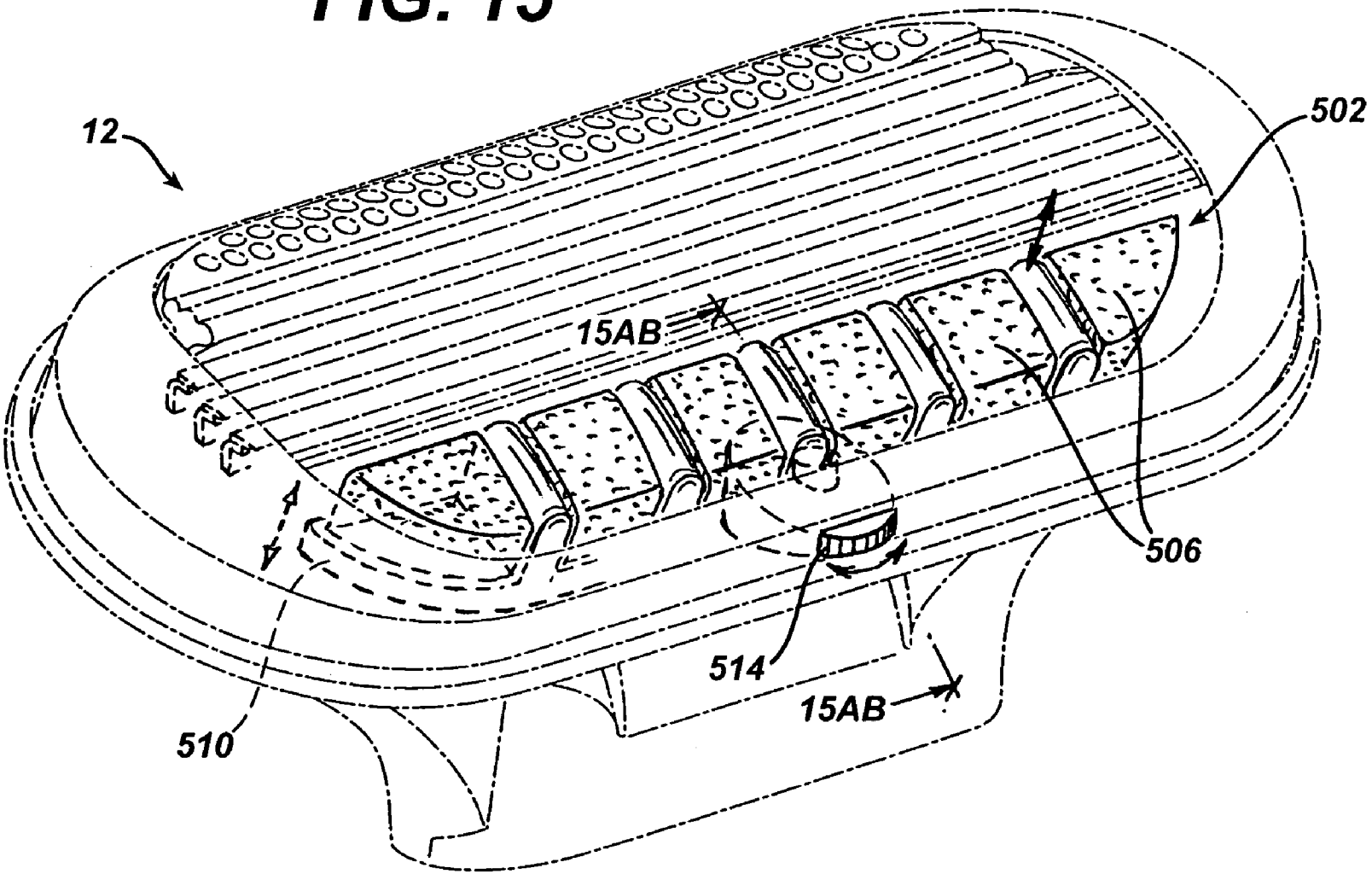
FIG. 15 is a perspective view of a cartridge.
Figure 15A:
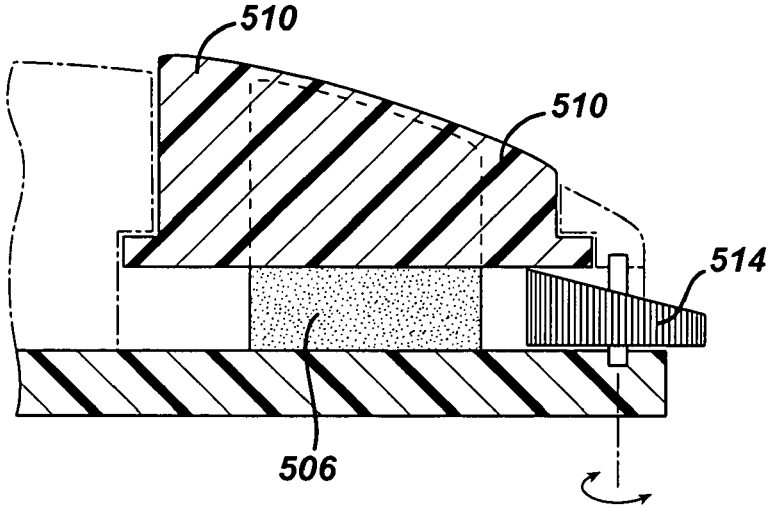
FIG. 15A is a cross-sectional view of a portion of the cartridge of FIG. 15, taken along line 15AB—15AB when the cartridge is in a position of low exfoliation.
Figure 15B:
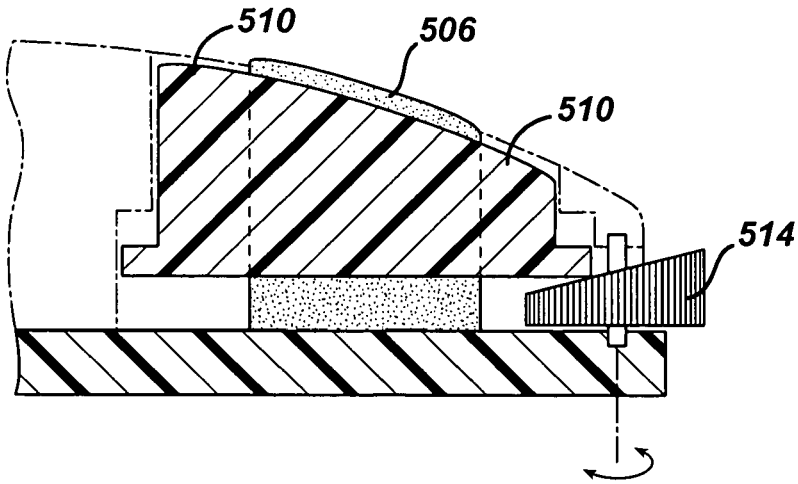
FIG. 15B is a cross-sectional view of a portion of the cartridge of FIG. 15, taken along line 15AB—15AB when the cartridge is in a position of high exfoliation.

For example, and referring now to FIGS. 15–15B, in some cases the degree of exfoliation provided by a razor cartridge is adjusted by moving a cartridge component other than the exfoliation member. In FIGS. 15–15B, cartridge 12 includes an exfoliation member 502 that is made up of six exfoliation patches 506. Although six exfoliation patches 506 are shown in FIGS. 15–15B, the exfoliation member can include a smaller number (e.g., one, two, three, four, five) of exfoliation patches, or a greater number (e.g., seven, eight, nine, ten) of exfoliation patches. Exfoliation patches 506 are surrounded by a frame 510 (made of, e.g., plastic) movable by a wheel actuator 514. As shown in FIGS. 15A and 15B, wheel actuator 514 is thicker in some areas than in others. Thus, as the user dials wheel actuator 514, frame 510 moves up or down, depending on the thickness of the portion of the wheel actuator beneath the frame. When frame 510 is flush with exfoliation patches 506 (as in FIG. 15A), the user will generally experience a low degree of exfoliation. By contrast, when frame 510 is positioned over the thinnest portion of wheel actuator 514 (as in FIG. 15B), the user will generally experience a high degree of exfoliation. Although not shown in FIGS. 15–15B, in some cases frame 510 can be moved to a higher position than that of the exfoliation patches, so that the patches generally make little to no contact with the user's skin.

In some embodiments, the exfoliation member can include a lubricating or moisturizing shaving aid matrix with a shaving aid. In certain cases, a lubricating or moisturizing shaving aid matrix with a shaving aid can be positioned adjacent the exfoliation member. Shaving aid matrices with shaving aids are described in co-owned and co-pending U.S. patent application Ser. No. 60/455,646, the disclosure of which was incorporated by reference above.

Multiple (e.g., at least two) exfoliation members can be used on one cartridge. For example, a cartridge can have three adjacent exfoliation members. The exfoliation members can be arranged generally along the same plane or can be arranged along different planes. For example, the exfoliation members can be arranged to form a curved exfoliating surface that is beneficial for contouring. The exfoliation members can have the same or different textures and/or degrees of roughness. The exfoliation members can be made of the same or different materials. In some embodiments, the exfoliation members can have different adjustment mechanisms.

Figure 16:
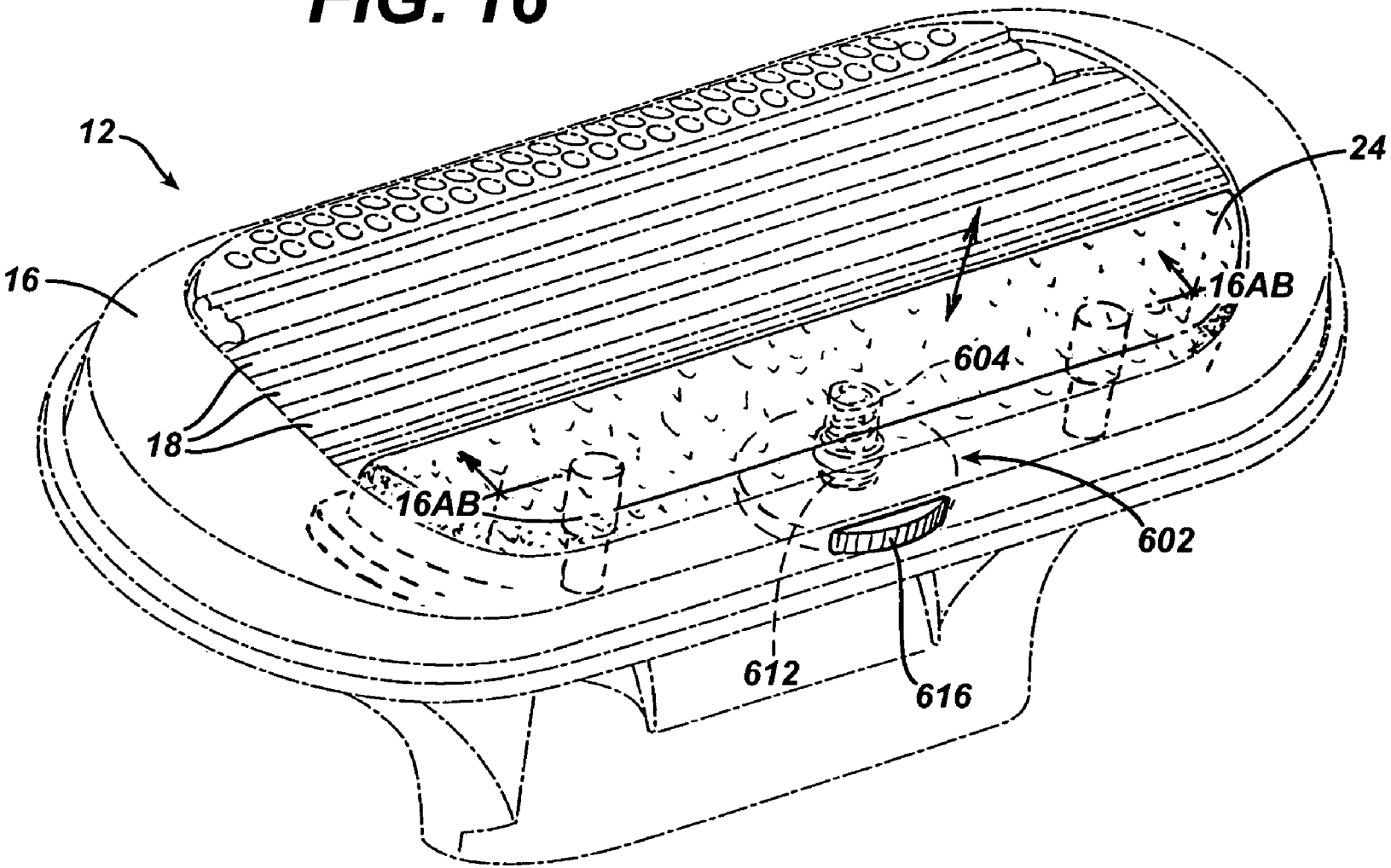
FIG. 16 is a perspective view of a cartridge.
Figure 16A:
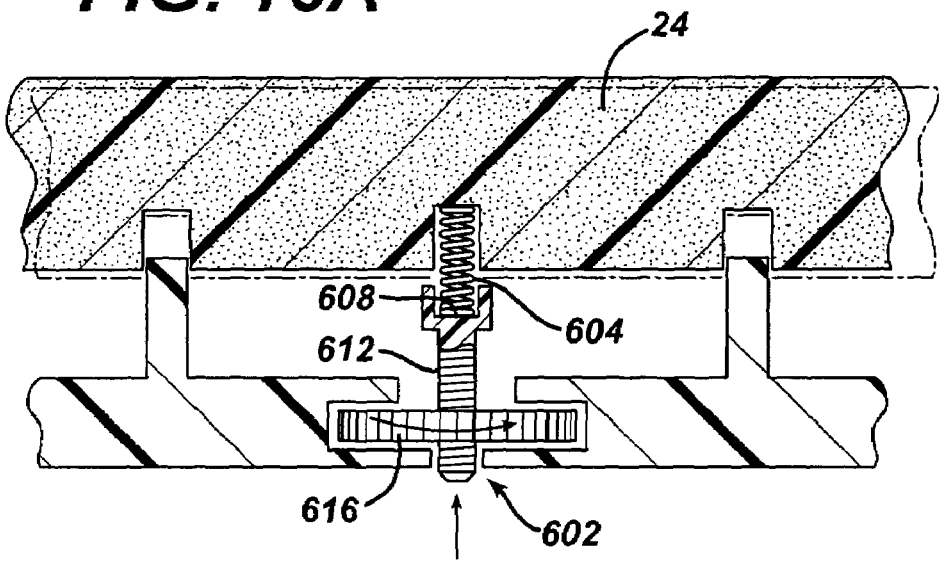
FIGS. 16A and 16B are partial cross-sectional views of a portion of the cartridge of FIG. 16, taken along line 16AB—16AB.
Figure 16B:
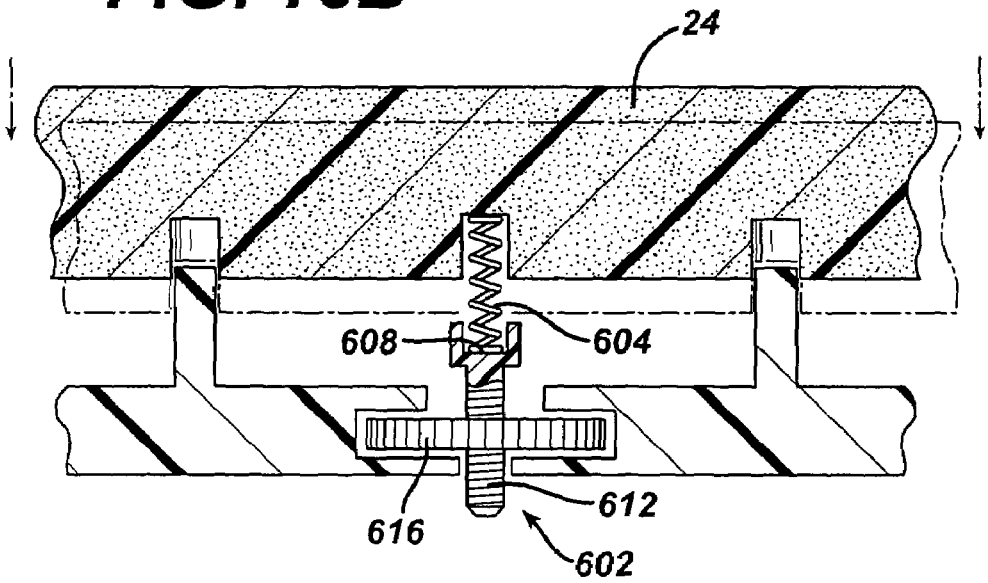

In certain embodiments, and referring now to FIGS. 16–16B, a spring disposed underneath an exfoliation member can be pre-loaded. In other words, the spring can be somewhat compressed between the exfoliation member and the cartridge body, such that the spring effectively has a "load" on it before the user has pressed against the exfoliation member. In FIGS. 16 and 16A, an adjustment mechanism 602 includes a spring 604, a post 612, and a thumb wheel 616. Spring 604 is compressed between exfoliation member 24 and a surface 608 of post 612. Referring particularly to FIGS. 16A and 16B, the user can dial thumb wheel 616 to move post 612. Movement of post 612 changes the degree of compression of spring 604, which in turn changes the amount of resistance encountered when a user presses exfoliation member 24 against his or her skin. While a post and thumb wheel are shown, the user can manually adjust the amount of pre-load in a spring by any of a number of different mechanisms (e.g., by using a slide or dial). An advantage to using an adjustable spring is that it can control the range of force with which the user will be able to exfoliate.

While the exfoliation member has been shown as part of the cartridge, in some cases the exfoliation member is separate from the cartridge, and encircles or otherwise surrounds the cartridge. In such cases, the position of the exfoliation member can be adjusted relative to the position of the cartridge.

In certain embodiments, the exfoliation member can include slots or holes for improved drainage of water through the cartridge. In some embodiments, the slots or holes can alternatively or additionally be used to introduce shaving aids and/or preparations to an area of exfoliation.

The exfoliation member can be attached to the cartridge body by, e.g., a hinge, or the exfoliation member can be integral with the cartridge body. For example, the exfoliation member can form a living hinge with the cartridge body.

While the shaving cartridges of FIGS. 1–8 and 10–16B are shown with three blades, in some cases the shaving cartridges can have fewer blades (e.g., one or two blades), or more blades (e.g., four blades, five blades, six blades).

In some embodiments, one or more of the blades in a wet-shaving system can be movable relative to the exfoliation member. Shaving systems with movable blades are described in Jacobson, U.S. Pat. No. 4,378,634, the entire contents of which are hereby incorporated by reference.

Other embodiments are within the scope of the following claims.

What is claimed is:

1. A wet-shaving system comprising:

a housing;

a blade member mounted on the housing;

an exfoliation member in proximity to the blade member and including abrasive particles or fibers; and a guard member positioned between the exfoliation member and the blade, wherein a position of the exfoliation member is adjustable relative to the housing to vary an amount of contact between the exfoliation member and a skin surface of a user during shaving.

2. The shaving system of claim 1, wherein the position of the exfoliation member relative to the housing is adjustable to vary a surface area of the exfoliation member that contacts the skin surface of the user.

3. The shaving system of claim 1, wherein a height of the exfoliation member relative to a leading edge of the blade member is adjustable.

4. The shaving system of claim 3, wherein the height of the exfoliation member relative to the leading edge of the blade member is adjustable to control pressure.

5. The shaving system of claim 1, wherein an angle of the exfoliation member relative to a leading skin-engaging surface of the housing is adjustable.

6. The shaving system of claim 5, wherein the angle of the exfoliation member relative to the leading skin-engaging surface of the housing is adjustable to control pressure.

7. The shaving system of claim 1, further comprising an adjustment mechanism constructed to adjust the position of the exfoliation member.

8. The shaving system of claim 7, wherein the adjustment mechanism comprises a cam disposed within a cavity defined by the exfoliation member.

9. The shaving system of claim 8, wherein the adjustment mechanism further comprises a shaft having a first end that is connected to the cam, and a second end that is disposed external to the housing, and wherein the cam is adapted to be actuated by movement of the shaft.

10. The shaving system of claim 7, wherein the adjustment mechanism comprises a link coupled to the exfoliation member at a first end and to a slide actuator at a second end, the slide actuator being capable of adjusting the position of the link.

11. The shaving system of claim 7, wherein the adjustment mechanism comprises a wheel having a thickness that varies around the circumference of the wheel, and wherein a first portion of the wheel is disposed beneath the exfoliation member, and a second portion of the wheel is exposed to allow the user to turn the wheel.

12. The shaving system of claim 11, wherein the exfoliation member is mounted on a hinge, and the wheel is configured to pivot the exfoliation member about the hinge.

13. The shaving system of claim 7, wherein the exfoliation member comprises a cylindrical roller disposed on a shaft, and the adjustment mechanism comprises a wheel configured to rotate the shaft.

14. The shaving system of claim 13, wherein the cylindrical roller defines an external surface upon which at least two different types of exfoliating elements are disposed.

15. The shaving system of claim 13, wherein the shaft comprises an eccentric shaft.

16. The shaving system of claim 7, wherein the adjustment mechanism comprises a rod disposed beneath the exfoliation member, and wherein the rod is adapted to apply pressure to the exfoliation member when the rod is actuated by a user.

17. The shaving system of claim 16, wherein the exfoliation member is mounted on a hinge, and the rod is configured to pivot the exfoliation member about the hinge.

18. The shaving system of claim 7, wherein the adjustment mechanism comprises an adjustable cover adapted to be positioned by the user over all, a portion, or none of an exposed surface of the exfoliation member.

19. The shaving system of claim 18, wherein the adjustable cover comprises a clear plastic material.

20. The shaving system of claim 7, wherein the adjustment mechanism comprises a screw thread post in contact with the exfoliation member, and wherein the screw thread post is disposed within a thumb wheel.

21. The shaving system of claim 7, wherein the adjustment mechanism comprises a spring disposed under the exfoliation member.

22. The shaving system of claim 21, wherein the spring comprises a wave spring.

23. The shaving system of claim 21, wherein the spring comprises a coil spring.

24. The shaving system of claim 1, wherein the exfoliation member comprises a bow plate.

25. The shaving system of claim 7, wherein the adjustment mechanism comprises a lever disposed beneath the exfoliation member.

26. The shaving system of claim 7, wherein the adjustment mechanism comprises a member selected from the group consisting of pivots, slides, levers, springs, cam surfaces, wheels and screws.

27. The shaving system of claim 1, wherein the exfoliation member comprises a plate, roller or pad.

28. The shaving system of claim 1, wherein the exfoliation member includes abrasive particles.

29. The shaving system of claim 1, wherein the exfoliation member comprises a shaving aid matrix including a shaving aid.

30. The shaving system of claim 1, wherein the exfoliation member is fixedly mounted, and a portion of the housing is movable relative to the exfoliation member.

31. The shaving system of claim 1, wherein the exfoliation member is fixedly mounted, and a shaving surface of the blade member is movable relative to the exfoliation member.

32. The shaving system of claim 1 wherein the guard is fixedly positioned relative to the housing.

33. The shaving system of claim 1 further comprising a cap.

34. The shaving system of claim 1 further comprising a cap, wherein the guard and exfoliation member are positioned forward of the blades and the cap is positioned behind the blades, such that the exfoliation member contacts a user's skin first, followed by the guard, blades and cap.

35. The shaving system of claim 34 wherein the cap and guard are fixedly positioned relative to the housing.

* * * * *